US010322786B1

(12) United States Patent
Anschuetz et al.

(10) Patent No.: US 10,322,786 B1
(45) Date of Patent: Jun. 18, 2019

(54) METHOD FOR CONTROLLING A MARINE INTERNAL COMBUSTION ENGINE

(71) Applicant: Brunswick Corporation, Mettawa, IL (US)

(72) Inventors: Steven M. Anschuetz, Fond du Lac, WI (US); Robert R. Osthelder, Omro, WI (US); Andrew J. Przybyl, Berlin, WI (US)

(73) Assignee: Brunswick Corporation, Mettawa, IL (US)

( * ) Notice: Subject to any disclaimer, the term of this patent is extended or adjusted under 35 U.S.C. 154(b) by 8 days.

(21) Appl. No.: 15/887,238

(22) Filed: Feb. 2, 2018

(51) Int. Cl.

| | |
|---|---|
| ***B63H 21/21*** | (2006.01) |
| ***F02D 41/00*** | (2006.01) |
| ***F02D 41/40*** | (2006.01) |
| ***F02D 41/30*** | (2006.01) |

(52) U.S. Cl.
CPC ..... *B63H 21/21* (2013.01); *F02D 41/3017* (2013.01); *F02D 41/40* (2013.01); *B63H 2021/216* (2013.01)

(58) Field of Classification Search
CPC ..... F02B 61/00; F02B 61/04; F02B 75/00; F02B 75/20; F02B 37/16; F02B 43/10; F02D 41/00; F02D 41/14; F02N 7/00; F02N 7/12
USPC ..... 440/84, 87; 123/674, 676, 679, 689
See application file for complete search history.

(56) References Cited

U.S. PATENT DOCUMENTS 5,713,339 A 2/1998 Kishida et al.
5,848,582 A 12/1998 Ehlers et al.
5,924,404 A 7/1999 Ruman et al.
5,988,139 A 11/1999 Wasilewski et al.
6,116,228 A * 9/2000 Motose ..... F02D 41/401 123/679
6,250,292 B1 6/2001 Suhre
6,273,771 B1 8/2001 Buckley et al.
(Continued)

OTHER PUBLICATIONS

Snyder, Matthew W., "Methods and Systems for Encoder Synchronization Using Spark and Fuel Modification", Unpublished U.S. Appl. No. 14/695,660, filed Apr. 24, 2015.
(Continued)

*Primary Examiner* — Lars A Olson
(74) *Attorney, Agent, or Firm* — Andrus Intellectual Property Law, LLP

(57) ABSTRACT

A method for controlling a marine engine's operating mode includes operating the engine in an initial operating mode according to an initial set of mapped parameter values configured to achieve an initial fuel/air equivalence ratio of an air-fuel mixture for combustion. If measured operating conditions of the engine meet lean-burn mode enablement criteria, the engine is operated in lean-burn mode according to a lean-burn set of mapped parameter values configured to achieve a lean-burn fuel/air equivalence ratio that is less than the initial fuel/air equivalence ratio. If the measured engine operating conditions no longer meet the lean-burn mode enablement criteria, the engine is operated in the initial operating mode. Transitions between the lean-burn mode and the initial operating mode are monitored. If the transitions indicate that the engine's operating mode is unstable, the engine is prevented from operating in the lean-burn mode until after a reset condition has been met.

20 Claims, 14 Drawing Sheets

(56) References Cited

U.S. PATENT DOCUMENTS

| | | | |
|---|---|---|---|
| 6,298,824 | B1 | 10/2001 | Suhre |
| 6,311,679 | B1 | 11/2001 | Druzhinina et al. |
| 6,726,512 | B2 | 4/2004 | Saito |
| 6,757,606 | B1 | 6/2004 | Gonring |
| 6,758,185 | B2 | 7/2004 | Surnilla et al. |
| 8,725,390 | B1 | 5/2014 | Snyder et al. |
| 9,067,662 | B2 | 6/2015 | Sako et al. |
| 2017/0089278 | A1* | 3/2017 | Tulapurkar ..... F02D 41/0027 |

OTHER PUBLICATIONS

Attainable Adventure Cruising, "Understanding an Engine Fuel Map", Chapter 2 of Online Book "Engines for Cruising Boats", Jun. 2, 2015, last accessed Apr. 7, 2017, available at https://www.morganscloud.com/2015/06/02/understandinganenginefuelmap/.

Anschuetz et al., "Method for Controlling a Marine Internal Combustion Engine", Unpublished U.S. Appl. No. 15/597,749, filed May 17, 2017.

Anschuetz et al., "Method for Controlling a Marine Internal Combustion Engine", Unpublished U.S. Appl. No. 15/597,752, filed May 17, 2017.

Anschuetz et al., "Method for Controlling a Marine Internal Combustion Engine", Unpublished U.S. Appl. No. 15/597,760, filed May 17, 2017.

Anschuetz et al., "Method for Controlling a Marine Internal Combustion Engine", Unpublished U.S. Appl. No. 15/843,275, filed Dec. 15, 2017.

* cited by examiner

METHOD FOR CONTROLLING A MARINE INTERNAL COMBUSTION ENGINE

FIELD

The present disclosure relates to internal combustion engines used to power marine propulsion devices on marine vessels.

BACKGROUND

U.S. Pat. No. 5,848,582 discloses a control system for a fuel injector system for an internal combustion engine that is provided with a method by which the magnitude of the start of air point for the injector system is modified according to the barometric pressure measured in a region surrounding the engine. This offset, or modification, of the start of air point adjusts the timing of the fuel injector system to suit different altitudes at which the engine may be operating.

U.S. Pat. No. 5,924,404 discloses a direct fuel injected two-stroke engine that controls spark ignition timing and/or ignition coil dwell time on a cylinder-specific basis. The engine also preferably controls fuel injection timing and amount and injection/delivery duration on a cylinder-specific basis. Cylinder-specific customization of spark ignition and fuel injection allows better coordination of spark with fuel injection which results in better running quality, lower emissions, etc. Memory in the electronic control unit for the engine preferably includes a high resolution global look-up table that determines global values for spark ignition and fuel injection control based on engine load (e.g. operator torque demand, throttle position, manifold air pressure, etc.) and engine speed. Memory in the electronic control unit also includes a plurality of low resolution, cylinder-specific offset value look-up tables from which cylinder-specific offset values for spark ignition and fuel injection can be determined, preferably depending on engine load and engine speed. The offset values are combined with the global values to generate cylinder-specific control signals for spark ignition and fuel injection.

U.S. Pat. No. 5,988,139 discloses an engine control system that digitally stores corresponding values of timing angles and engine speeds and selects the timing angles based on the operating speed of the engine. In the engine speed range near idle speed, the timing angle is set to a pre-selected angle after top dead center (ATDC) and the relationship between engine speed and timing angle calls for the timing angle to be advanced from the pre-selected angle after top dead center (ATDC) to successively advancing angles which subsequently increase angles before top dead center (BTDC) as the engine increases in speed. In one application, a timing angle of 10 degrees after top dead center (ATDC) is selected for a engine idle speed of approximately 800 RPM. This relationship, which is controlled by the engine control unit, avoids stalling the engine when an operator suddenly decreases the engine speed.

U.S. Pat. No. 6,250,292 discloses a method which allows a pseudo throttle position sensor value to be calculated as a function of volumetric efficiency, pressure, volume, temperature, and the ideal gas constant in the event that a throttle position sensor fails. This is accomplished by first determining an air per cylinder (APC) value and then calculating the mass air flow into the engine as a function of the air per cylinder (APC) value. The mass air flow is then used, as a ratio of the maximum mass air flow at maximum power at sea level for the engine, to calculate a pseudo throttle position sensor value. That pseudo TPS (BARO) value is then used to select an air/fuel target ratio that allows the control system to calculate the fuel per cycle (FPC) for the engine.

U.S. Pat. No. 6,298,824 discloses a control system for a fuel injected engine including an engine control unit that receives signals from a throttle handle that is manually manipulated by an operator of a marine vessel. The engine control unit also measures engine speed and various other parameters, such as manifold absolute pressure, temperature, barometric pressure, and throttle position. The engine control unit controls the timing of fuel injectors and the injection system and also controls the position of a throttle plate. No direct connection is provided between a manually manipulated throttle handle and the throttle plate. All operating parameters are either calculated as a function of ambient conditions or determined by selecting parameters from matrices which allow the engine control unit to set the operating parameters as a function of engine speed and torque demand, as represented by the position of the throttle handle.

U.S. Pat. No. 6,757,606 discloses a method for controlling the operation of an internal combustion engine that includes the storing of two or more sets of operational relationships which are determined and preselected by calibrating the engine to achieve predetermined characteristics under predetermined operating conditions. The plurality of sets of operational relationships are then stored in a memory device of a microprocessor and later selected in response to a manually entered parameter. The chosen set of operational relationships is selected as a function of the selectable parameter entered by the operator of the marine vessel and the operation of the internal combustion engine is controlled according to that chosen set of operational parameters. This allows two identical internal combustion engines to be operated in different manners to suit the needs of particular applications of the two internal combustion engines.

U.S. Pat. No. 8,725,390 discloses systems and methods for optimizing fuel injection in an internal combustion engine that adjust start of fuel injection by calculating whether one of advancing or retarding start of fuel injection will provide a shortest path from a source angle to a destination angle. Based on the source angle and a given injection pulse width and angle increment, it is determined whether fuel injection will overlap with a specified engine event if start of fuel injection is moved in a direction of the shortest path. A control circuit increments start fuel injection in the direction of the shortest path if it is determined that fuel injection will not overlap with the specified engine event, or increments start fuel injection in a direction opposite that of the shortest path if it is determined that fuel injection will overlap with the specified engine event.

Unpublished U.S. patent application Ser. No. 15/597,749, filed May 17, 2017, discloses a method for controlling a marine internal combustion engine, which is carried out by a control module and includes: operating the engine according to a initial set of mapped parameter values configured to achieve a first fuel-air equivalence ratio in a combustion chamber of the engine; measuring current values of engine operating conditions; and comparing the engine operating conditions to predetermined lean-burn mode enablement criteria. In response to the engine operating conditions meeting the lean-burn enablement criteria, the method includes: (a) automatically retrieving a subsequent set of mapped parameter values configured to achieve a second, lesser fuel/air equivalence ratio and transitioning from operating the engine according to the initial set of mapped parameter values to operating the engine according to the subsequent set of mapped parameter values; or (b) presenting an operator-selectable option to undertake such a transition, and in response to selection of the option, commencing the transition.

Unpublished U.S. patent application Ser. No. 15/597,752, filed May 17, 2017, discloses a method for controlling a marine engine including operating the engine according to an initial set of mapped parameter values to achieve a first target fuel-air equivalence ratio, determining a first actual fuel-air equivalence ratio, and using a feedback controller to minimize a difference between the first target and actual ratios. Feedback controller outputs are used to populate an initial set of adapt values to adjust combustion parameter values from the initial set of mapped parameter values. The method includes transitioning to operating the engine according to a subsequent set of mapped parameter values to achieve a different target fuel-air equivalence ratio. The method includes determining a second actual fuel-air equivalence ratio, using the feedback controller to minimize a difference between the second target and actual ratios, and using feedback controller outputs to populate a subsequent set of adapt values to adjust combustion parameter values from the subsequent set of mapped parameter values.

Unpublished U.S. patent application Ser. No. 15/597,760, filed May 17, 2017, discloses a marine engine operating according to first and second sets of mapped parameter values to achieve a first fuel-air equivalence ratio and maintaining a stable output torque while transitioning to operating according to third and fourth sets of mapped parameter values to achieve a different fuel-air equivalence ratio. The first and third sets of mapped parameter values correspond to a first combustion parameter. The second and fourth sets correspond to a second combustion parameter. The transition includes: (a) transitioning from operation according to a current value of the first combustion parameter to operation according to a target value thereof; (b) transitioning from operation according to a current value of the second combustion parameter to operation according to a target value thereof; and (c) timing commencement or completion of step (b) and setting a rate of step (b) to counteract torque discontinuity that would otherwise result when performing step (a) alone.

Unpublished U.S. patent application Ser. No. 15/843,275, filed Dec. 15, 2017, discloses a method for controlling a marine internal combustion engine including operating the engine in a lean-burn mode, wherein a first fuel/air equivalence ratio of an air/fuel mixture in a combustion chamber of the engine is less than 1. The method includes comparing a change in operator demand to a delta demand deadband; comparing a speed of the engine to an engine speed deadband; and comparing a throttle position setpoint to a throttle position threshold. The method also includes immediately disabling the lean-burn mode in response to: (a) the change in operator demand being outside the delta demand deadband, and (b) at least one of: (i) the engine speed being outside the engine speed deadband, and (ii) the throttle position setpoint exceeding the throttle position threshold. The engine thereafter operates according to a set of mapped parameter values configured to achieve a second fuel/air equivalence ratio of at least 1.

The above-noted patents and patent applications are hereby incorporated by reference in their entireties.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to one example of the present disclosure, a method for controlling a marine internal combustion engine, which method is carried out by a control module, comprises receiving a measured operating condition of the engine and comparing the measured engine operating condition to a lean-burn mode enablement criterion. In response to the measured engine operating condition meeting the lean-burn mode enablement criterion, the method includes operating the engine in a lean-burn mode, wherein a fuel/air equivalence ratio of an air-fuel mixture in a combustion chamber of the engine is less than 1. The method also includes counting a number of switches of the measured engine operating condition between meeting the lean-burn mode enablement criterion and not meeting the lean-burn mode enablement criterion. In response to the number of switches exceeding a given threshold number of switches within a given period of time, the method includes thereafter preventing the engine from operating in the lean-burn mode until after a reset condition has been met.

Another method for controlling an operating mode of a marine internal combustion engine, which method is carried out by a control module, is disclosed herein. The method includes operating the engine in an initial operating mode according to an initial set of mapped parameter values configured to achieve an initial fuel/air equivalence ratio of an air-fuel mixture in a combustion chamber of the engine. In response to measured operating conditions of the engine meeting given lean-burn mode enablement criteria, the method includes operating the engine in a lean-burn mode according to a lean-burn set of mapped parameter values configured to achieve a lean-burn fuel/air equivalence ratio of the air-fuel mixture that is less than the initial fuel/air equivalence ratio. In response to the measured engine operating conditions no longer meeting the lean-burn mode enablement criteria, the method includes operating the engine in the initial operating mode. The method also includes monitoring transitions between the lean-burn mode and the initial operating mode. In response to the transitions indicating that the operating mode of the engine is unstable, the method includes thereafter preventing the engine from operating in the lean-burn mode until after a reset condition has been met.

BRIEF DESCRIPTION OF THE DRAWINGS

The present disclosure is described with reference to the following Figures. The same numbers are used throughout the Figures to reference like features and like components.

DETAILED DESCRIPTION

In the present description, certain terms have been used for brevity, clarity and understanding. No unnecessary limitations are to be inferred therefrom beyond the requirement of the prior art because such terms are used for descriptive purposes only and are intended to be broadly construed.

Figure 1:
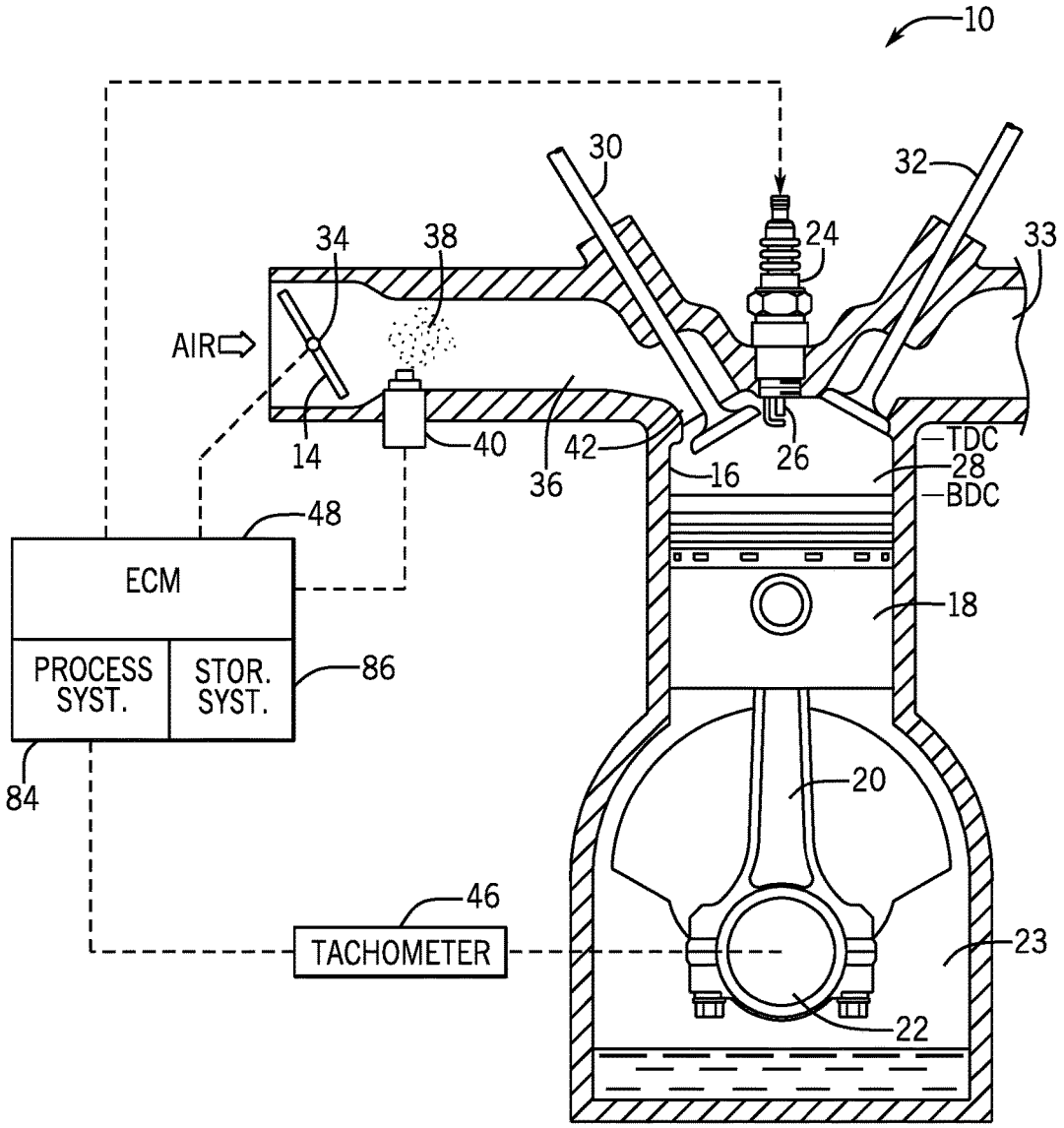
FIG. 1 is a schematic of a marine engine.

FIG. 1 shows an exemplary, but highly simplified, schematic of a four cycle internal combustion engine 10. Although only one cylinder 16 is shown, it should be understood that in most applications of internal combustion engines, a plurality of cylinders 16 are typically used. It should be understood that FIG. 1 is highly simplified for purposes of clarity and to permit the general operation of the internal combustion engine 10 to be described. Within the cylinder 16, a piston 18 is disposed for reciprocating movement therein. The piston 18 is attached to a connecting rod 20 which, in turn, is attached to a crankshaft 22. The crankshaft 22 rotates about an axis within a crankcase 23, and this rotational movement causes the connecting rod 20 to move the piston 18 back and forth within the cylinder 16 between two limits of travel. The position shown in FIG. 1 represents the piston 18 at its bottom dead center (BDC) position within the cylinder 16. After the crankshaft 22 rotates 180 degrees about its axis, the piston 18 will move to its uppermost position at top dead center (TDC). A sparkplug 24 is configured to provide an igniting spark at its tip 26 to ignite a mixture of fuel and air within the combustion chamber 28.

An intake valve 30 and an exhaust valve 32 are shown, with the intake valve 30 being shown in an opened position and the exhaust valve 32 being shown in a closed position. A throttle valve 14 is shown as being pivotable about center 34 to regulate the flow of air through an air intake conduit 36 of the engine. Fuel 38 is introduced into the air intake conduit 36, in the form of a mist, through fuel injector 40. Although the engine 10 shown herein is an indirect injection engine, the present disclosure also relates to direct injection engines. It should also be understood that the location of the fuel injector 40 could be different from that shown herein, which is only for exemplary purposes. After combustion, byproducts are exhausted from combustion chamber 28 through exhaust valve 32 to exhaust conduit 33.

During operation of the engine 10 shown in FIG. 1, air flows through the air intake conduit 36 under the control of the throttle valve 14. Fuel 38 introduced into the air stream as a mist passes with the air through an intake port 42, which conducts the air-fuel mixture into the combustion chamber 28. The timing of the engine determines the point, relative to the rotation of the crankshaft 22, when the sparkplug 24 is fired to ignite the air-fuel mixture within the combustion chamber 28. If the sparkplug 24 fires before the piston 18 reaches its uppermost position within cylinder 16, it is referred to as being fired before top dead center (BTDC). If the sparkplug 24 is fired when the piston 18 is on its way down from its uppermost position in FIG. 1, it is referred to as being fired after top dead center (ATDC). The crankshaft 22 rotates through 360 degrees of rotation as the piston 18 moves through its entire reciprocating motion. It is typical to refer to the timing of events related to combustion within an engine in terms of the crank angle before top dead center (BTDC) or after top dead center (ATDC), with reference to the position of the piston 18 when the event occurs.

With continued reference to FIG. 1, a tachometer 46 is shown schematically connected in signal communication with the crankshaft 22 or some other device, such as a gear tooth wheel, connected to the crankshaft 22 to allow its rotational speed to be measured. This information from the tachometer 46 is provided to the engine control module (ECM) 48. In a typical application, the engine control module 48 comprises a processor that digitally stores information necessary to allow the ECM 48 to control the timing of the engine 10. A signal is sent from the ECM 48 to an ignition system 76 (FIG. 2) or some other suitable device (e.g., ignition coils, power transistors) to cause the sparkplug 24 to fire.

The throttle valve 14 in FIG. 1 is typically caused to pivot about its center of rotation 34 by electro-mechanical movement of the throttle valve 14 in response to an operator command, as will be described below. In most applications, the throttle valve 14 can be moved from an open position to a closed position where the air passing through the air intake conduit 36 is virtually stopped. However, it should be understood that in most applications of internal combustion engines, means is generally provided to allow a small amount of air to bypass the plate of the throttle valve 14 during idle engine speed conditions in order to allow the engine 10 to continue to operate, although at a significantly reduced speed. This reduced flow of air can be provided by small holes formed through the throttle valve 14 or other bypass channels formed in the structure of the air intake conduit 36. It should be understood that movement of the throttle valve 14 from a closed position to an open position increases the operational speed of the engine and movement of the throttle valve 14 from an open position to a closed position reduces the operational speed of the engine.

Figure 2:
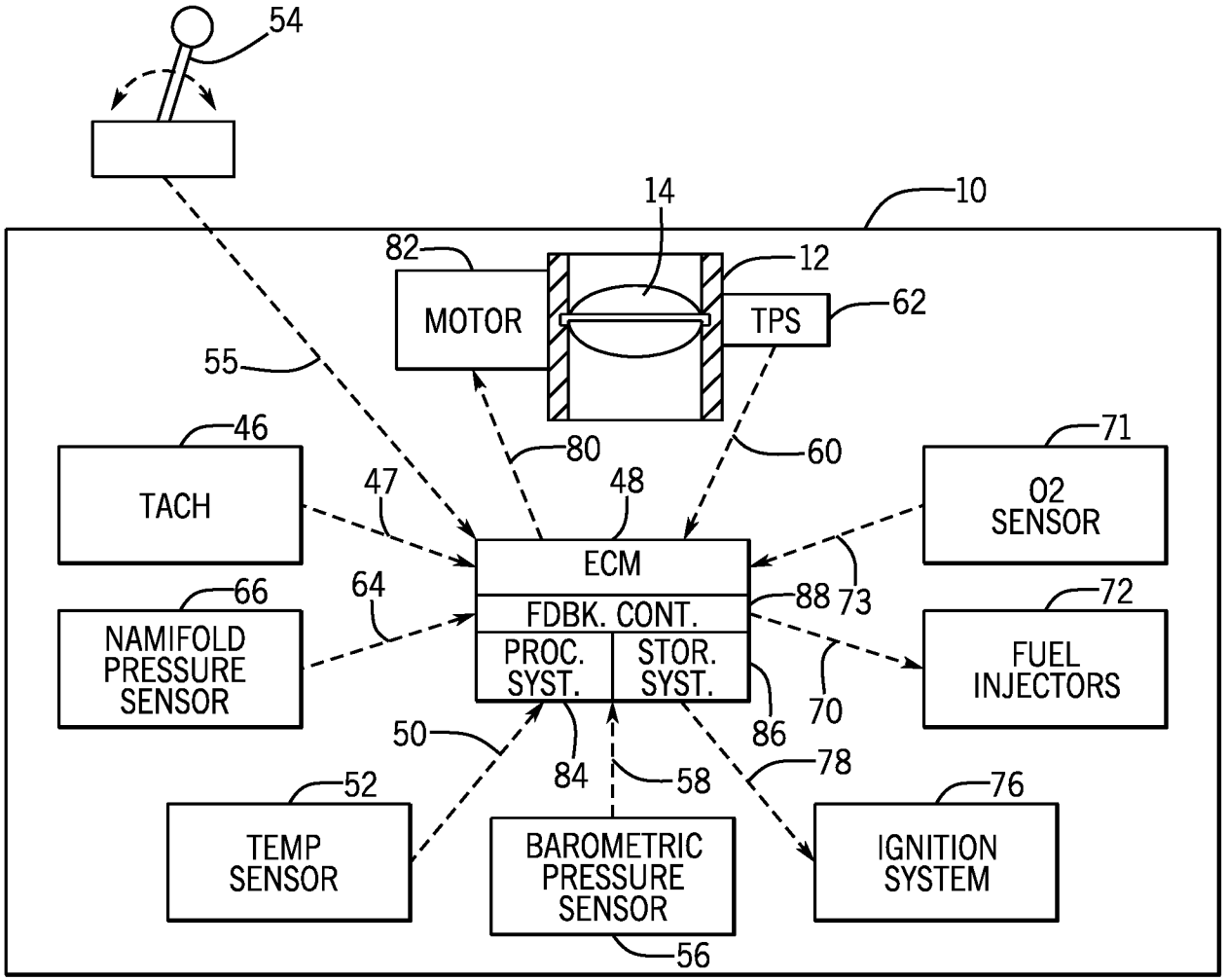
FIG. 2 is a schematic of a marine engine control system.

FIG. 2 is a highly simplified schematic representation of a control system for the engine 10 defining the cylinder 16 of FIG. 1. As noted herein above, as it enters the engine 10, air passes by the throttle valve 14, which is rotatably supported in a throttle body structure 12. The ECM 48 is shown as being connected in signal communication with several sensors in order to enable the ECM 48 to properly select the magnitudes of fuel and air that are provided to each cylinder of the engine 10. For example, the ECM 48 is provided with information that represents the actual angular position of the throttle valve 14. This information is provided on line 60 by a throttle position sensor 62.

With continued reference to FIG. 2, another one of the sensor signals provided to the ECM 48 represents the physical position of a throttle lever 54. The throttle lever 54 is manually moveable, and a signal is provided to the ECM 48 on line 55, which represents the position of the throttle lever 54. The signal on line 55 in turn represents an operator demand for desired torque or desired engine speed. The ECM 48 is also provided with a signal on line 47 representing actual engine speed. The signal can be provided by the tachometer 46 or any other instrument that is capable of providing a signal to the ECM 48 representing engine speed. On line 64, the ECM 48 is provided with a signal that is representative of manifold pressure, such as the pressure in air intake conduit 36. Any type of manifold pressure sensor 66 that is capable of providing information to the ECM 48 that is representative of manifold absolute pressure can be used for these purposes. On line 50, the ECM 48 is provided with information representing the temperature at one or more selective locations on the engine 10. Various types of temperature sensors 52 are suitable for these purposes. The ECM 48 is also provided with information regarding atmospheric pressure, from a barometric pressure sensor 56, on line 58. An oxygen sensor 71 provides a reading related to an amount of oxygen, for example in the engine's exhaust, to the ECM 48 on line 73. The oxygen sensor 71 may be a lambda sensor such as a wide-band oxygen sensor.

The ECM 48 provides certain output signals that allows it to control the operation of certain components relating to the engine 10. For example, the ECM 48 provides signals on line 70 to fuel injectors 72 to control the amount of fuel provided to each cylinder per each engine cycle. The ECM 48 also controls the ignition system 76, including the sparkplug 24, by determining the timing and spark energy of each ignition event. The output signals provided by the ECM 48 for these purposes are provided on line 78.

FIG. 2 shows the schematic representation of the various sensors and components that are used by the ECM 48 to control the operation of the engine 10 in direct response to the position of a throttle lever 54. It should be understood that the position of the throttle lever 54 is, in actuality, a demand by the operator of a marine vessel for a relative amount of torque to be provided to the propeller shaft of the propulsion system, or in another example, for a relative speed of the engine coupled to the propeller shaft. The position of the throttle lever 54 can be moved by the operator of the marine vessel at any time during the operation of the marine vessel. For example, if the marine vessel is traveling at a generally constant speed, the operator of the marine vessel can move the throttle lever 54 in one direction to increase the vessel speed by providing increased torque to the propeller shaft (or by increasing engine speed) or, alternatively, the operator of the marine vessel can move the throttle lever 54 in the opposite direction to decrease the amount of torque provided to the propeller shaft (or to decrease the engine speed) and, as a result, decrease the speed of the marine vessel. It should be noted that no direct physical connection need be provided between the throttle lever 54 and the throttle valve 14. Instead, the ECM 48 receives the operator demand signals on line 55 that represent the position of the throttle lever 54 and combines that information with other information relating to the operation of the engine 10 to provide appropriate signals on line 80. The signals on line 80 then cause a throttle motor 82 to rotate the throttle valve 14 to a desired position to achieve the operator demand received on line 55 from the throttle lever 54.

The ECM 48 may include a feedback controller 88 that uses the readings from the throttle lever 54, tachometer 46, oxygen sensor 71, throttle position sensor 62, and/or other sensors on the engine 10 or vessel to calculate the signals to be sent over line 80 to throttle motor 82, over line 78 to ignition system 76 (including sparkplug 24), and over line 70 to fuel injectors 72.

In the example shown, ECM 48 is programmable and includes a processor and a memory. The ECM 48 can be located anywhere in the system and/or located remote from the system and can communicate with various components of the marine vessel via a peripheral interface and wired and/or wireless links, as will be explained further herein below. Although FIGS. 1 and 2 each show only one ECM 48, the system can include more than one control module. Portions of the method disclosed herein below can be carried out by a single control module or by several separate control modules. If more than one control module is provided, each can control operation of a specific device or sub-system on the marine vessel.

In some examples, the ECM 48 may include a processing system 84, storage system 86, software, and input/output (I/O) interfaces for communicating with peripheral devices. The systems may be implemented in hardware and/or software that carries out a programmed set of instructions. For example, the processing system 84 loads and executes software from the storage system, which directs the processing system 84 to operate as described herein below in further detail. The system may include one or more processors, which may be communicatively connected. The processing system 84 can comprise a microprocessor, including a control unit and a processing unit, and other circuitry, such as semiconductor hardware logic, that retrieves and executes software from the storage system. The processing system 84 can be implemented within a single processing device but can also be distributed across multiple processing devices or sub-systems that cooperate according to existing program instructions.

As used herein, the term "control module" may refer to, be part of, or include an application specific integrated circuit (ASIC); an electronic circuit; a combinational logic circuit; a field programmable gate array (FPGA); a processor (shared, dedicated, or group) that executes code; other suitable components that provide the described functionality; or a combination of some or all of the above, such as in a system-on-chip (SoC). A control module may include memory (shared, dedicated, or group) that stores code executed by the processing system. The term "code" may include software, firmware, and/or microcode, and may refer to programs, routines, functions, classes, and/or objects. The term "shared" means that some or all code from multiple control modules may be executed using a single (shared) processor. In addition, some or all code from multiple control modules may be stored by a single (shared) memory. The term "group" means that some or all code from a single control module may be executed using a group of processors. In addition, some or all code from a single control module may be stored using a group of memories.

The storage system 86 can comprise any storage media readable by the processing system 84 and capable of storing software. The storage system 86 can include volatile and non-volatile, removable and non-removable media implemented in any method or technology for storage of information, such as computer-readable instructions, data structures, software program modules, or other data. The storage system 86 can be implemented as a single storage device or across multiple storage devices or sub-systems. The storage system 86 can include additional elements, such as a memory controller capable of communicating with the processing system. Non-limiting examples of storage media include random access memory, read-only memory, magnetic discs, optical discs, flash memory, virtual and non-virtual memory, various types of magnetic storage devices, or any other medium which can be used to store the desired information and that may be accessed by an instruction execution system. The storage media can be a transitory storage media or a non-transitory storage media such as a non-transitory tangible computer readable medium.

The ECM 48 communicates with one or more components of the control system via I/O interfaces and a communication link, which can be a wired or wireless link, and is shown schematically by lines 55, 47, 64, 50, 58, 78, 70, 73, 60, and 80. The ECM 48 is capable of monitoring and controlling one or more operational characteristics of the control system and its various subsystems by sending and receiving control signals via the communication link. In one example, the communication link is a controller area network (CAN) bus, but other types of links could be used. It should be noted that the extent of connections of the communication link shown herein is for schematic purposes only, and the communication link in fact provides communication between the ECM 48 and each of the peripheral devices and sensors noted herein, although not every connection is shown in the drawings for purposes of clarity.

Figure 3:
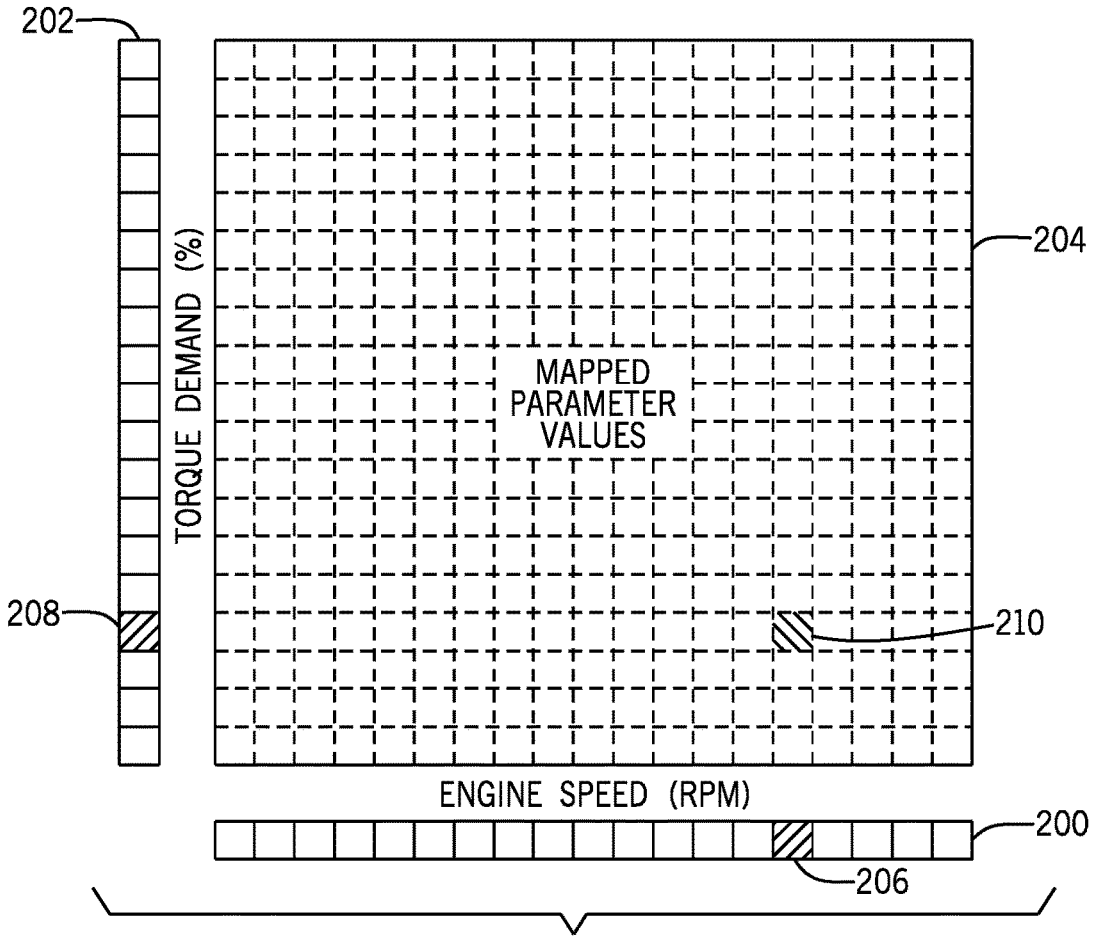
FIG. 3 illustrates a generic example of an input-output map for determining a generic engine control parameter.

In order to convert the input signal on line 55, which relates to the operator demand, to output signals on each of line 80 to move the throttle motor 82, line 78 to control the ignition system 76, and line 70 to control the fuel injectors 72, the ECM 48 uses a number of input-output maps saved in the storage system 86. FIG. 3 shows the basic structure of an input-output map 204 of a parameter value. The map shown in FIG. 3 does not contain any values and is intended to describe a basic concept used to implement the present methods. The mapped parameter values stored in the storage system 86 of the ECM 48 can be a fuel per cylinder (FPC), a throttle position setpoint (TPS), spark plug activation timing, or any other numeric parameter required by the present algorithms. In the example in which the operator demand represents a desired torque, most of the mapped parameter values used by the present algorithms are stored as a function of two measured variables, engine speed measured in RPM and operator demand measured as a percentage of maximum operator demand. The actual current engine speed is received by the ECM 48 on line 47 from the tachometer 46 or other sensor that is capable of providing a measured engine speed value. Operator demand is a value that represents the position of the throttle lever 54, stored as a percentage, of its maximum (i.e., fully forward) position. Both of the independent variables, engine speed and operator demand, are provided with an ordinate array, 200 and 202 respectively. The ordinate arrays are one-dimensional arrays that contain values that allow the processing system 84 to select the appropriate row or column of the map 204 based on the independent variables measured by the sensors and provided to the ECM 48. For example, the ordinate array 200 associated with engine speed will contain magnitudes of RPM that represent the associated columns in the map 204. Similarly, the one dimensional array 202 would contain various percentages that assist the processing system 84 in selecting a row of the map 204. For example, if the engine speed is determined to match the category represented by entry 206 of ordinate array 200 and the operator demand is determined to be represented by the range contained in entry 208 of ordinate array 202, these two values are used to select the column and row, respectively, in the map 204. In the example used in conjunction with FIG. 3, this would result in the selection of the value contained at location 210 of map 204.

Continuing with this example, if the map 204 represented a fuel per cylinder (FPC) value, the value would be selected from location 210 and used for the intended purposes. It should be understood that the arrangement represented in FIG. 3 is used in the present algorithms to select many different variables as a function of engine speed and operator demand. It should also be understood that the specific dimensions of the map 204 are not limiting on the present disclosure. For example, certain map matrices are n by n in dimension while others are m by m in dimension. Similarly, it is not a requirement of the present invention that the matrices be equal in its both dimensions. For example, certain data magnitudes may be more appropriately stored in an n by m matrix, while others are able to be stored in m by m matrices. The size and dimensions of each data map 204 are determined as a function of the required resolution needed to appropriately select the rows and columns of the map. For purposes of the following description, the representative matrices will be provided with a darkened entry, such as that identified by reference numeral 210 in FIG. 3, to represent the fact that only a single numeric variable is used from any particular map during any particular calculation.

The use of catalytic converters using oxidizing catalysts to remove CO and HC, and reducing catalysts to remove CO and $NO_x$, etc., or three-element catalysts, is known as method of cleansing exhaust gas emissions from internal combustion engines. These are mainly used in automobile engines. Because they have different regulatory requirements than automobile engines, non-catalyzed marine engines have the ability to run in lean-burn, during which the engine is operated at a fuel/air ratio that is less than stoichiometric (or an air/fuel ratio that is greater than stoichiometric). For a gasoline engine, the stoichiometric air/fuel ratio is 14.7:1. The stoichiometric air/fuel ratio is used to calculate a phi value ($\phi = AFR_{stoich}/AFR$), where $\phi=1$ when the air-fuel mixture is at stoichiometric. In contrast, when running in lean-burn, an engine's air-fuel mixture will have a target phi value that is less than 1, and in one non-limiting example is about 0.85. Lean-burn operation is therefore at a target air/fuel ratio that is at least 14.8:1, and in one non-limiting example is about 17.3:1. Operating an engine in lean burn can have a significant impact on improving fuel economy. However, the region in which an engine can operate efficiently in lean burn is limited by the coefficient of variation (CoV) of combustion, emissions, torque availability, and drivability. The lean region can be further limited by altitude, engine coolant temperature, fuel system issues, and other engine faults. The potential gain in fuel economy from running in lean-burn can be improved by using a binary on/off type of algorithm for initiating and ending lean-burn, and by undertaking changes in engine combustion parameters between operating in the stoichiometric region and operating in lean-burn separately of one another. This allows the lean-burn operating zone of the engine to be pushed to the edges of predetermined run quality, emissions, and efficiency limits.

Although the determinations of the ECM 48 about to be described herein below will be related to the fuel/air equivalence ratio ϕ (phi), it should be understood that the relative quantities of fuel and air in the combustion chamber 28 may also or instead be expressed in terms of the air/fuel equivalence ratio λ (lambda), the air/fuel ratio (AFR), or the fuel/air ratio (FAR), depending on the programming of the ECM 48. These ratios are related to one another by way of simple mathematics and/or known stoichiometric values, and any of them can be easily determined using the reading from the oxygen sensor 71.

Figure 4A:
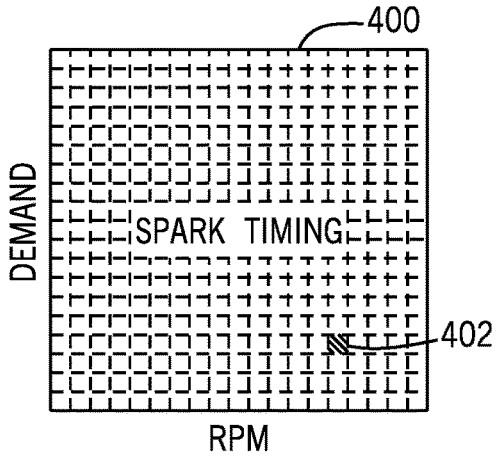
FIGS. 4A and 4B illustrate specific examples of input-output maps for determining timing of ignition of spark plugs of the engine.
Figure 4B:
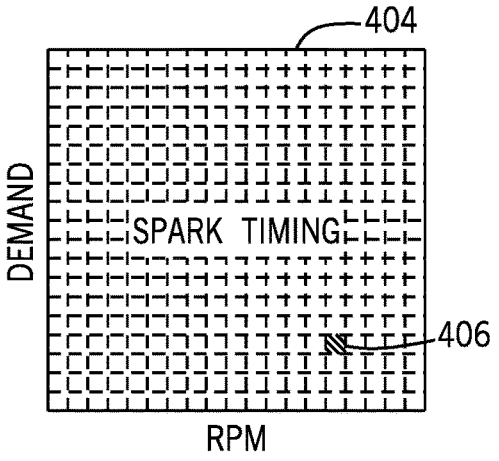
Figure 5A:
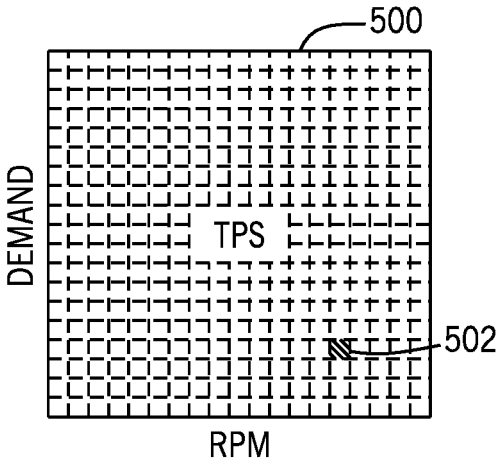
FIGS. 5A and 5B illustrate specific examples of input-output maps for determining air quantity in a combustion chamber of the engine.
Figure 5B:
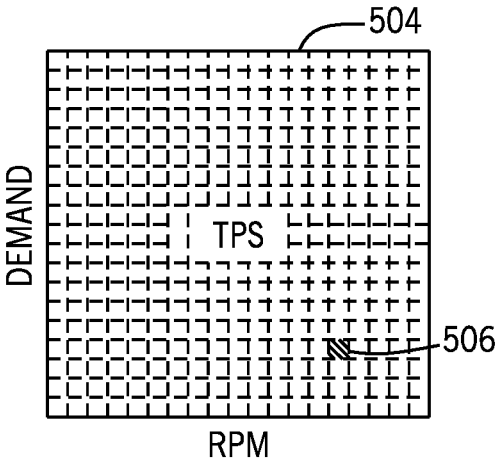
Figure 6A:
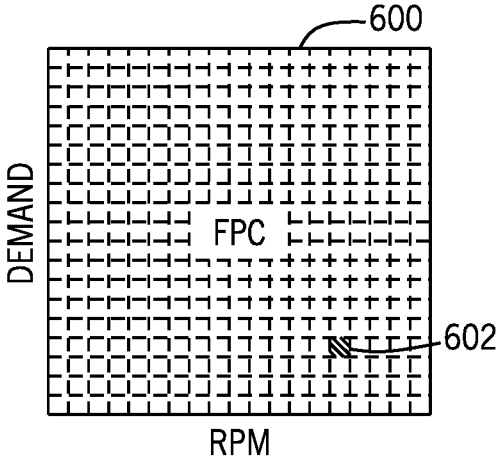
FIGS. 6A and 6B illustrate specific examples of input-output maps for determining fuel quantity in the engine's combustion chamber.
Figure 6B:
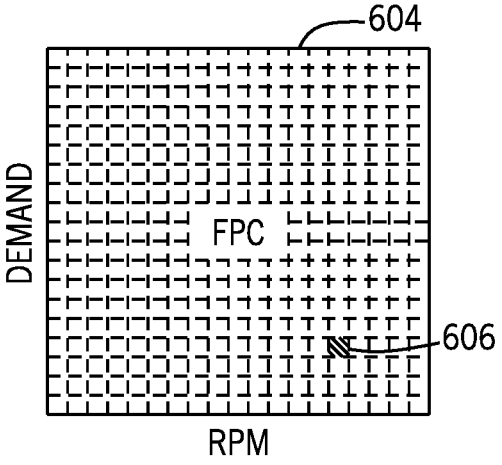

Referring to FIGS. 4A-6B, the present methods use separate sets of combustion parameter maps when the engine 10 is running in the stoichiometric region than when the engine 10 is running in lean burn. Separate stoichiometric and lean-burn combustion parameter maps are saved in the storage system 86 of the ECM 48 for each of three combustion parameters: a timing of activation of the spark-plug 24 associated with the combustion chamber 28, a quantity of fuel to be supplied to the combustion chamber 28 by way of fuel injector 40, and a quantity of air to be supplied to the combustion chamber 28 by way of throttle valve 14. For example, FIG. 4A shows a stoichiometric map for spark plug activation timing, while FIG. 4B shows a lean-burn map or an offset map for spark plug activation timing; FIG. 5A shows a stoichiometric map for air quantity, while FIG. 5B shows a lean-burn map or an offset map for air quantity; and FIG. 6A shows a stoichiometric map for fuel quantity, while FIG. 6B shows a lean-burn map or an offset map for fuel quantity.

Figure 14:
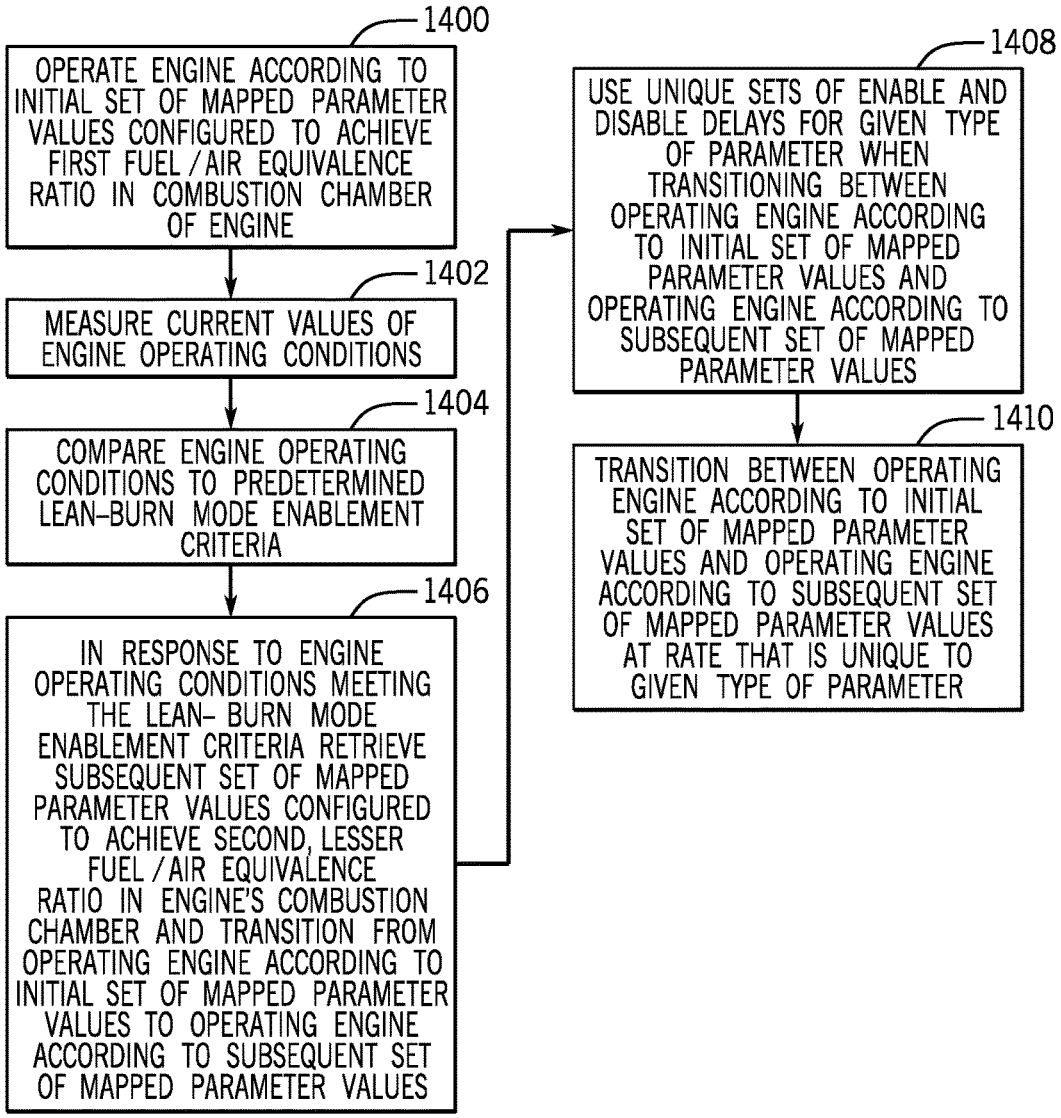
FIGS. 14-17 illustrate various methods for transitioning between stoichiometric operation and lean burn operation of the engine.

Turning now to FIG. 14, a method for controlling a marine internal combustion engine 10 will be described. The method is carried out by a control module (e.g., the ECM 48) and, as shown at 1400, includes operating the engine 10 according to an initial set of mapped parameter values configured to achieve a first fuel/air equivalence ratio in a combustion chamber 28 of the engine 10. As shown at 1402, the method includes measuring current values of engine operating conditions. For example, the ECM 48 may obtain information related to a barometric pressure of an atmosphere surrounding the engine 10 from the barometric pressure sensor 56 on line 58. As another example, the ECM 48 may obtain information relating to the temperature of the engine 10 from the temperature sensor 52 on line 50. Other engine operating conditions can also be measured and/or noted. Next, as shown at 1404, the method includes comparing the engine operating conditions to predetermined lean-burn mode enablement criteria. According to the present disclosure, the lean-burn mode enablement criteria may include one or more of the following: the engine 10 is running; the barometric pressure of the atmosphere surrounding the engine 10 is greater than a predetermined barometric pressure; the temperature of the engine 10 is greater than a predetermined temperature; and no active engine faults are present that would inhibit lean burn. In one example, the ECM 48 may store a list of predetermined engine faults that, if present, would inhibit lean burn, such as but not limited to: a barometric pressure range fault, a camshaft sensor fault, a crankshaft sensor fault, fuel injector faults, an intake air temperature sensor fault, a MAP sensor fault, an oxygen sensor fault, a coolant temperature sensor fault, or a throttle position sensor fault.

It should be understood that the algorithm may require that all or fewer than all of the lean-burn mode enablement criteria be met before the method will continue. Additional lean-burn mode enablement criteria may be used. For example, the lean-burn mode enablement criteria may also include that the engine is operating within a lean-burn mode enablement zone as determined by a combination of a speed of the engine 10 and an operator demand, as will be described below with respect to FIG. 7. Returning to FIG. 14, as shown at 1406, in response to the engine operating conditions meeting the lean-burn mode enablement criteria, the method includes automatically retrieving a subsequent set of mapped parameter values configured to achieve a second, lesser fuel/air equivalence ratio in the engine's combustion chamber 28 and automatically transitioning from operating the engine 10 according to the initial set of mapped parameter values to operating the engine 10 according to the subsequent set of mapped parameter values.

In one example, the first fuel/air equivalence ratio is greater than or equal to 1 (i.e., the fuel/air ratio is at or above the stoichiometric fuel/air ratio for gasoline), although it should be understood that other fuel/air equivalence ratios could be used. The mapped parameter values in FIGS. 4A, 5A, and 6A would therefore respectively provide spark advance or retard information related to the spark plug timing, throttle position setpoint (TPS) information calibrated to achieve a given air quantity in the combustion chamber 28, and fuel per cylinder (FPC) information calibrated to achieve a given fuel quantity in the combustion chamber 28, which together result in the first fuel/air equivalence ratio. In one example, the second fuel/air equivalence ratio is less than 1 (i.e., the fuel/air ratio is less than stoichiometric), and is at or about $\phi=0.85$, although it should be understood that other fuel/air equivalence ratios could be used. The mapped parameter values in FIGS. 4B, 5B, and 6B would therefore respectively provide spark advance or retard information related to the spark plug timing, throttle position setpoint (TPS) information calibrated to achieve a given air quantity in the combustion chamber 28, and fuel per cylinder (FPC) information calibrated to achieve a given fuel quantity in the combustion chamber 28, which together result in the second fuel/air equivalence ratio. It should be understood that not only can the first and second fuel/air equivalence ratios be other than stoichiometric ($\phi=1$) and lean-burn ($\phi=0.85$), respectively, the first and second fuel/air equivalence ratios could also be reversed, such that the engine 10 transitions from operating at lean burn to operating at stoichiometric. Hereafter, many examples of the present disclosure will be described with respect to transitioning from stoichiometric operation to lean-burn operation, but it should be understood that the same principles apply in general when transitioning from a first (or initial) fuel/air equivalence ratio to a second (or subsequent) fuel/air equivalence ratio.

Figure 15:
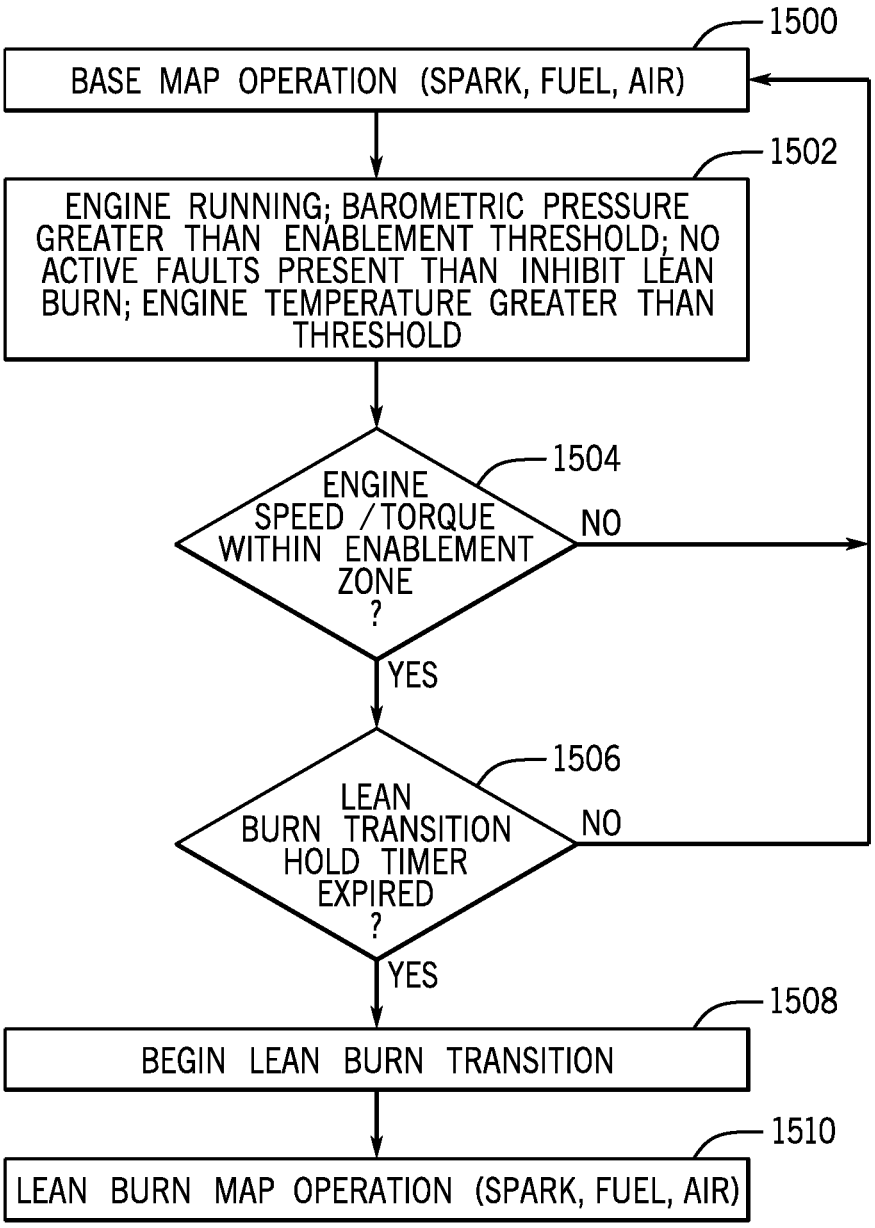

By way of specific example, as shown in FIG. 15, the engine 10 may start by operating according to base (stoichiometric) maps of parameter values for spark, fuel, and air, as shown at 1500. The ECM 48 may then conduct a lean-burn initial criteria check, as shown at 1502. As noted above, the ECM 48 may check if the engine 10 is running, the barometric pressure is greater than an enablement threshold, that no predetermined engine fault is present that would inhibit lean burn, and that the engine temperature is greater than an enablement threshold. Being able to disable lean burn under certain conditions, such as at altitude (i.e., low barometric pressure), during cold drive-away, or if certain faults occur, allows a specifically controlled use of the lean burn feature. Once each of the conditions at 1502 is true, the ECM 48 will check if the engine speed and engine load are within a lean-burn enablement zone, as shown at 1504. Engine speed can be determined using the tachometer 46, while engine load can be determined using the readings from the throttle position sensor 62, throttle lever 54, and/or manifold pressure sensor 66. In general, the lean-burn enablement zone is within the middle range of engine operation, when the engine 10 is operating at or near midrange speeds and at midrange load (such as, for example, 50-70% of maximum rated speed/load, although other delimitations for what is considered "midrange" could used).

Figure 7:
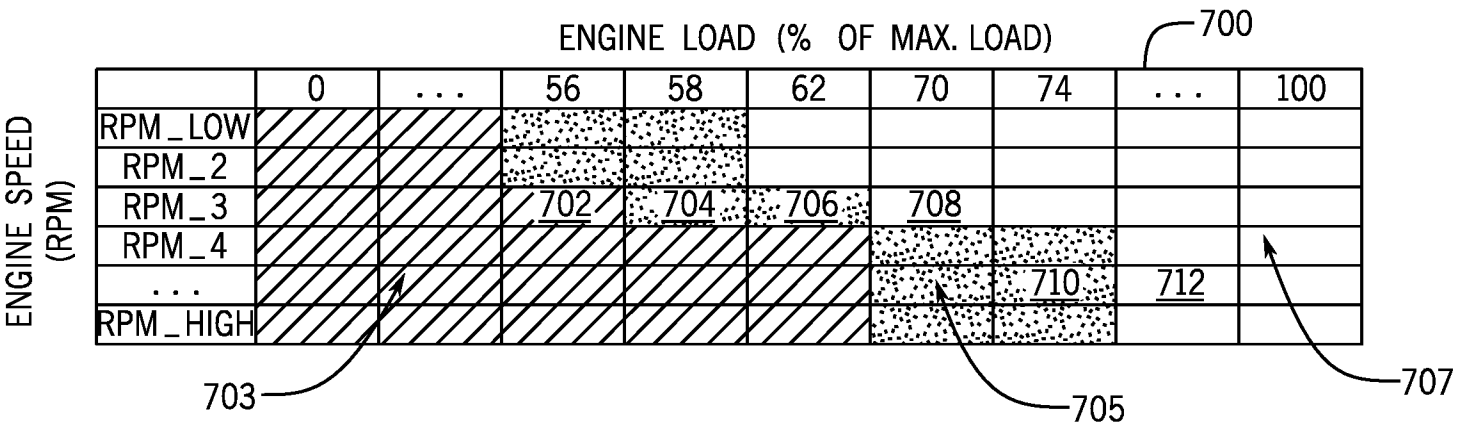
FIG. 7 illustrates an example of an input-output map identifying lower and upper engine speed thresholds and throttle valve position thresholds for operating the engine in a lean-burn mode.

FIG. 7 shows an exemplary input-output map 700 delineating the lean-burn enablement zone. In the example discussed below, engine load is determined by the position of the throttle lever 54, which corresponds to operator demand. Engine load (operator demand) is represented in the top row as ranging from 0% to 100% of maximum load. Several exemplary operator demand percentages are shown towards the center of map 700 for purposes of describing a lean-burn transition zone and a throttle position threshold. As shown in the left hand column, engine speed inputs range from RPM_LOW to RPM_HIGH. The RPM_LOW value represents a lower threshold below which lean-burn mode cannot be enabled, while the RPM_HIGH value represents an upper threshold above which the lean-burn mode cannot be enabled. These values therefore define the boundaries of the lean-burn enablement zone with respect to engine speed. In one example, RPM_LOW is about 2,100 RPM, although this value could range anywhere from 2,000 to 2,200 RPM. RPM_HIGH is about 5,800 RPM, although this value could range anywhere from 5,000 to 6,000 RPM.

The current engine speed (as determined by the tachometer 46) and the current operator demand (as determined from the throttle lever 54) are input to look up a throttle position setpoint in a corresponding cell of the input-output map 700. The hatched cells at the left-hand side of the map 700 represent pairs of conditions at which the system is operating within the lean-burn mode enablement zone 703. For example, cell 702 holds a value for the throttle position setpoint corresponding to an engine speed of RPM_3 and an operator demand of 56%. Assuming that the other lean-burn mode enablement conditions noted hereinabove with respect to box 1502 of FIG. 15 are met, when the system is operating at the engine speed of RPM_3 and the operator demand of 56%, lean-burn mode can be enabled with the throttle position setpoint at this value.

Each of the stippled cells at the middle of the map 700 represents a pair of conditions at which the system will transition into or out of the lean-burn mode. For example, cell 704 contains a throttle position setpoint for the engine speed of RPM_3 and an operator demand of 58%, and represents the lower limit of the transition zone 705. If the operator were to increase demand from 56% to 58% at engine speed RPM_3, the system would begin to transition out of the lean-burn mode according to the switch from cell 702 to cell 704. Cell 706 corresponds to the engine speed of RPM_3 and an operator demand of 62%, and represents the upper limit of the transition zone 705. As operator demand increases from 58% to 62%, the algorithm ramps out the throttle position setpoint from the value in cell 704 to the value in cell 706, as will be described herein below with respect to FIGS. 12 and 16.

The white cells at the right-hand side of the map 700 represent pairs of conditions at which lean-burn cannot be enabled. Cell 708, corresponding to the engine speed of RPM_3 and an operator demand of 70%, is within this non-enablement zone 707. Thus, a throttle position threshold is defined between the transition zone 705 and the non-enablement zone 707, above which throttle position threshold lean-burn cannot be enabled. The cells in the non-enablement zone 707 hold throttle position setpoints that exceed the throttle position threshold. As suggested by the stepped shape of the transition zone 705, the throttle position threshold varies with engine speed. In other words, the throttle position threshold between cells 706 and 708 is different than the throttle position threshold between cells 710 and 712.

Each of the engine speed, operator demand, and corresponding throttle position setpoint and threshold values in input-output map 700 can be calibrated for a specific vessel application. Note that values between those shown can be interpolated. Additionally, while the above example described engine load (operator demand) increasing while engine speed remained constant, in other examples, engine speed could increase with increasing operator demand, although there could be a lag between the two. It should be understood that the input-output map 700 can also be used to initiate a transition from the non-enablement zone 707, through the transition zone 705, and into the lean-burn mode enablement zone 703, although the example above described a transition in the opposite direction.

Returning to FIG. 15, if the condition at 1504 is not true, i.e., if the engine speed and engine load are not within the lean-burn mode enablement zone 703, the algorithm returns to 1500. If the engine 10 is operating at midrange speed and midrange load (YES at 1504), the ECM 48 next checks if a lean-burn transition hold timer has expired, as shown at 1506. Utilizing the timer ensures that the engine 10 is not in a transient state, which would result in lean burn enabling and disabling more frequently than desired. If no, or if any of the other enablement conditions fails during the duration of the timer, the method returns to 1500. If yes, the ECM 48 begins the transition to lean burn, as shown at 1508. The ECM 48 transitions to using unique lean burn maps for operation of the engine 10, as shown at 1510.

According to the present disclosure, the initial set of mapped parameter values is contained in a first input-output map that is unique from a second input-output map containing the subsequent set of mapped parameter values, both of which are saved in the storage system 86. That is, the map 400 shown in FIG. 4A is unique from the map 404 shown in FIG. 4B; the map 500 shown in FIG. 5A is unique from the map 504 shown in FIG. 5B; and the map 600 shown in FIG. 6A is unique from the map 604 shown in FIG. 6B. Additionally, the ECM 48 uses unique sets of enable and disable delays for a given type of parameter (i.e., spark, fuel, or air) when transitioning between operating the engine 10 according to the initial set of mapped parameter values (found in maps 400, 500, 600) and operating the engine 10 according to the subsequent set of mapped parameter values (found in maps 404, 504, 604). The ECM 48 also transitions between operating the engine 10 according to the initial set of mapped parameter values and operating the engine 10 according to the subsequent set of mapped parameter values at a rate that is unique to the given type of parameter. These steps are shown at 1408 and 1410 of FIG. 14, respectively.

Note that the same lean-burn enablement criteria noted at 1502 and 1504 being untrue will disable lean burn at any time during or after a transition into lean burn. Therefore, the present example also includes transitioning from operating the engine 10 according to the subsequent (lean-burn) set of mapped parameter values to operating the engine 10 according to the initial (stoichiometric) set of mapped parameter values in response to one or more of the engine operating conditions no longer meeting one or more of the respective lean-burn mode enablement criteria. In fact, both during the transition and while operating in lean burn, the ECM 48 will regularly or continuously check the lean-burn enablement criteria by comparing them to measured values of engine operating conditions. If any of the lean-burn enablement criteria becomes untrue, lean burn transition or operation is terminated, and the ECM 48 returns the system to operating in maps 400, 500, and 600 using unique disable delays and ramps, as will be described below.

Figure 16:
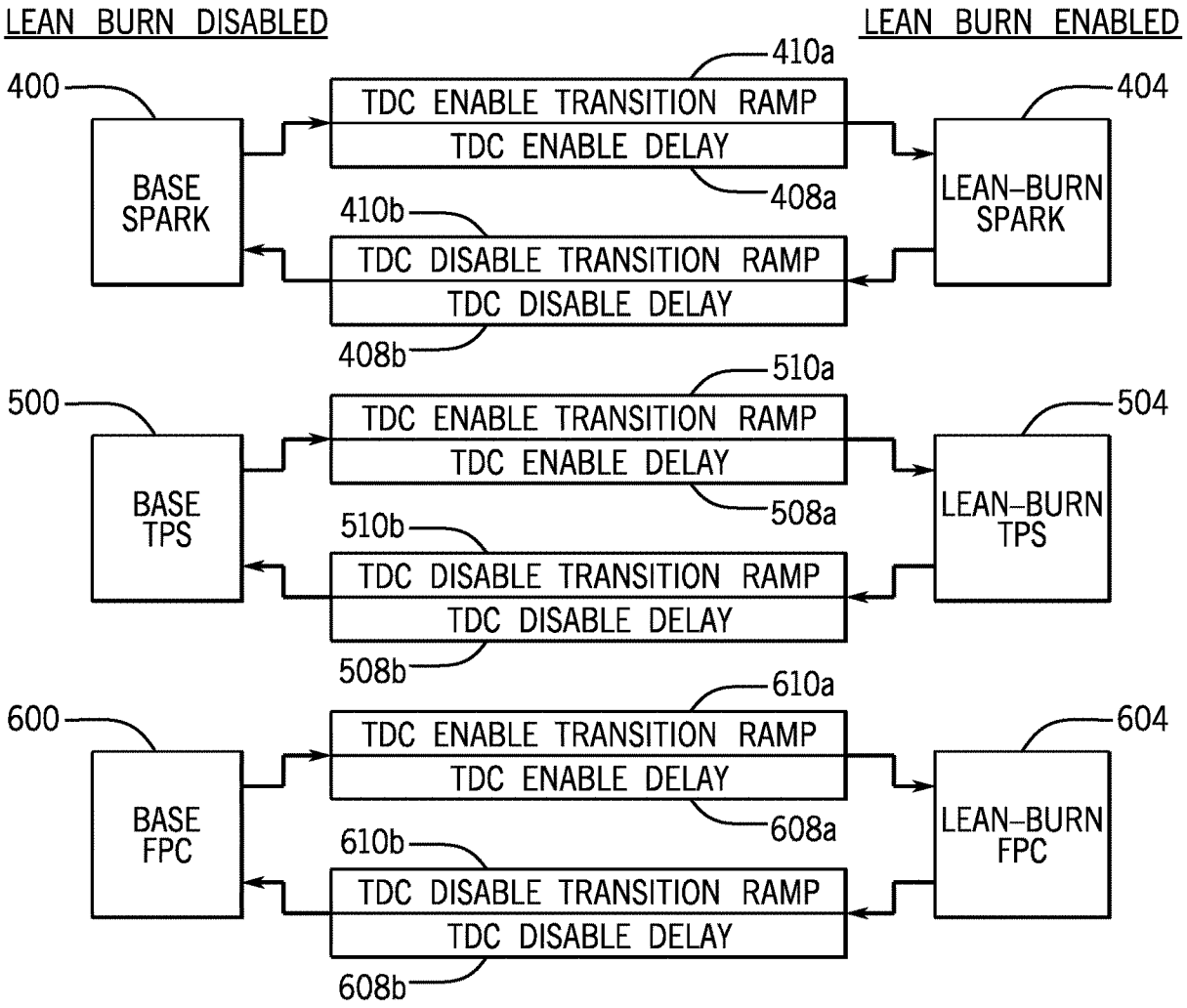

The above-noted concepts are shown generally in FIG. 16, where base spark, air, and fuel maps 400, 500, 600 are shown on the left-hand side as being used when lean-burn is disabled, and lean-burn spark, air, and fuel maps 404, 504, 604 are shown on the right-hand side as being used when lean-burn is enabled. To transition between the two sets of mapped parameter values, the ECM 48 uses unique enable/disable delays. The ECM 48 uses a first set of enable and disable delays 408*a*, 408*b* when transitioning between operating the engine 10 according to base spark plug activation timing data from map 400 and operating the engine 10 according to lean-burn spark plug activation timing data from map 404. The ECM 48 utilizes a second set of enable and disable delays 508*a*, 508*b* when transitioning between operating the engine 10 according to the base air quantity data from map 500 and operating the engine 10 according to the lean-burn air quantity data from map 504. The ECM 48 utilizes a third set of enable and disable delays 608*a*, 608*b* when transitioning between operating the engine 10 according to the base fuel quantity data from map 600 and operating the engine 10 according to the lean-burn fuel quantity data from map 604. These unique delays essentially mean that the spark plug activation timing, fuel quantity, and air quantity can be changed separately from one another during the transition period. Controlling when the base/lean-burn maps transition with respect to one another, as well as the rate at which transitions are made from a base map to a lean-burn map and vice versa, provides a seamless transition into and out of lean burn.

Because the combustion parameters are each scheduled to change during the enable or disable transition period, and because each parameter starts and ends at a unique value, each parameter also has a unique set of enable and disable rates. Continuing with reference to FIG. 16, the ECM 48 transitions at a first rate 410*a* between operating the engine 10 according to base spark plug activation timing data from map 400 and operating the engine according to lean-burn spark plug activation timing data from map 404. The transition out of lean burn may occur at a rate 410*b*, which may be the same as or different from the first rate 410*a*. The ECM 48 transitions at a second rate 510*a* between operating the engine 10 according to the base air quantity data from map 500 and operating the engine 10 according to lean-burn air quantity data from map 504. The transition out of lean burn may occur at a rate 510*b*, which may be the same as or different from the second rate 510*a*. The ECM 48 also transitions at a third rate 610*a* between operating the engine 10 according to base fuel quantity data from map 600 and operating the engine 10 according to lean-burn fuel quantity data from map 604. The transition out of lean burn may occur at a rate 610*b*, which may be the same as or different from the third rate 610*a*. These unique rates can be expressed as linear lengths of time, as being with respect to TDCs, or as desired slopes/ramps to be used for transitioning from one combustion parameter value to another.

In one example, the subsequent set of mapped parameter values comprises offset values to be added to the initial set of mapped parameter values or by which the initial set of mapped parameters is to be multiplied. That is, the maps 404, 504, 604 may contain offset values or multipliers to be added to or multiplied with a corresponding value from the base maps 400, 500, 600, which offset values or multipliers change the stoichiometric values from the base maps 400, 500, 600 into lean-burn values.

Note that each transition between a base map and a lean burn map (or between the base map and the base-map-plus-offset map) occurs between corresponding values in each map. That is, when transitioning from using base map 400 to lean-burn map 404, the ECM 48 will transition from using a spark timing value found at location 402 to using a spark timing value found at corresponding location 406. Before the transition, other engine speeds and operator demands might command values of spark timing from other cell locations, but once a decision to transition has been made, the current value at location 402 is used as the starting value for the transition. After the transition to the value at location 406 is completed, other engine speeds and operator demands might thereafter command values of spark timing from other cell locations. The same principle holds true for transitions between the maps for the other combustion parameters, where the exemplary current values at locations 502 and 602 are used as the starting points for transition, and the exemplary target values at locations 506 and 606 are used as the ending points. Thus, the present method includes transitioning from operating the engine 10 according to a current value of a given combustion parameter determined from the initial set of mapped parameter values to operating the engine 10 according to a target value of the given combustion parameter determined from the subsequent set of mapped parameter values.

Figure 17:
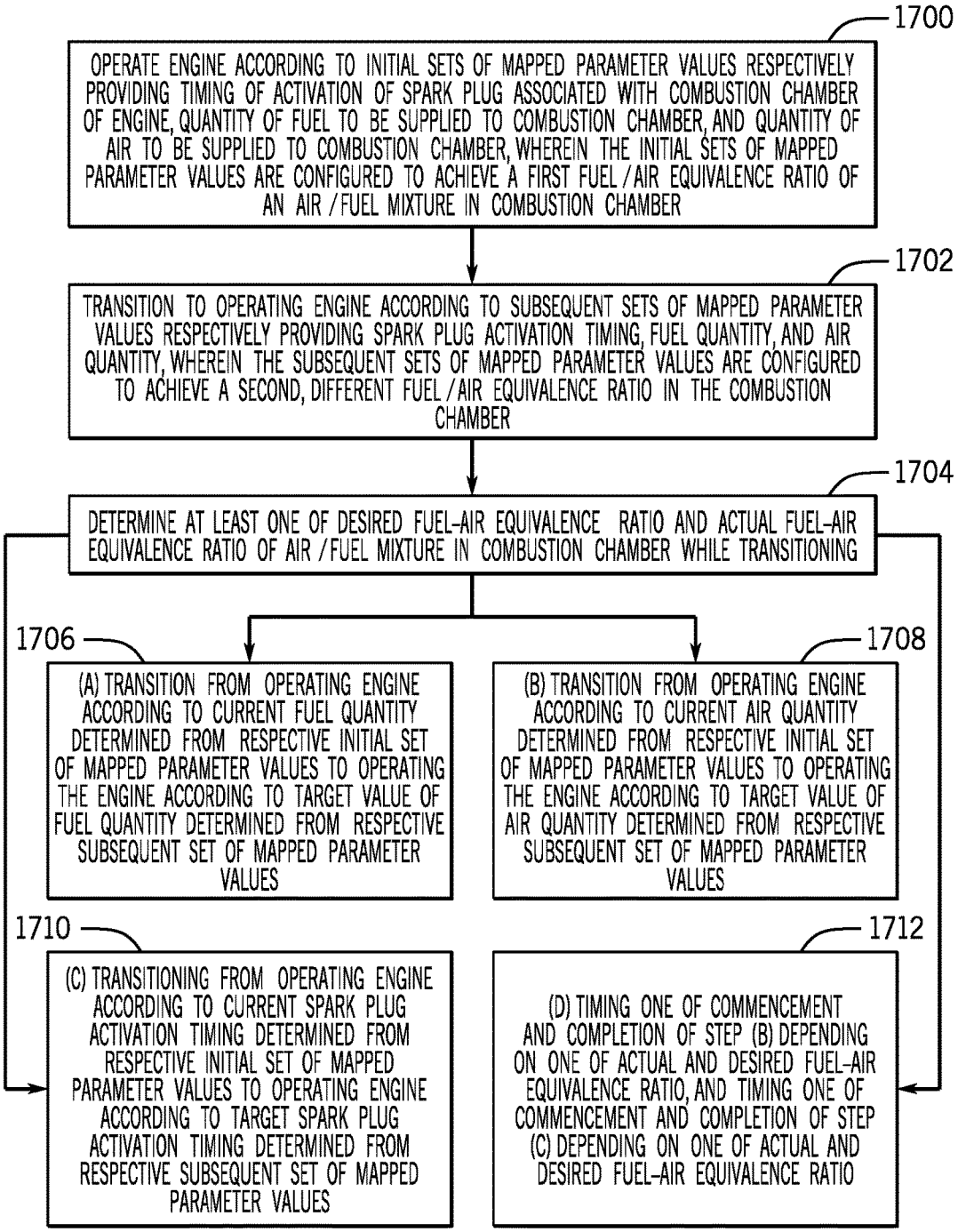

Scheduling of the spark, fuel, and air adjustments and how they are cadenced with respect to one another has a significant influence on how the transition into and out of lean burn feels to riders in a marine vessel. Referring now to FIG. 17, a method for controlling such cadencing will be described. As shown at 1700, the method includes operating the engine 10 according to initial sets of mapped parameter values respectively providing a timing of activation of the sparkplug 24 associated with a combustion chamber 28 of the engine (e.g., map 400, FIG. 4A), a quantity of air to be supplied to the combustion chamber 28 (e.g., map 500, FIG. 5A), and a quantity of fuel to be supplied to the combustion chamber 28 (e.g., map 600, FIG. 6A), wherein the initial sets of mapped parameter values are configured to achieve a first fuel/air equivalence ratio of an air-fuel mixture in the combustion chamber 28. As shown at 1702, the method next includes transitioning to operating the engine 10 according to subsequent sets of mapped parameter values respectively providing the spark plug activation timing (e.g., map 404, FIG. 4B), the air quantity (e.g., map 504, FIG. 5B), and the fuel quantity (e.g., map 604, FIG. 6B), wherein the subsequent sets of mapped parameter values are configured to achieve a second, different fuel/air equivalence ratio of the air-fuel mixture in the combustion chamber 28.

As shown at 1704, the method also includes determining at least one of a desired fuel/air equivalence ratio and an actual fuel/air equivalence ratio of the air-fuel mixture in the combustion chamber 28 while carrying out the step of transitioning (step 1702). The actual fuel/air equivalence ratio can be determined by measuring an amount of oxygen in exhaust exiting the combustion chamber 28 and determining the actual fuel/air equivalence ratio based on the amount of oxygen. For this purpose, the oxygen sensor 71 can be placed downstream of the exhaust valve 32, along the exhaust conduit 33. For example, if the oxygen sensor 71 is a lambda sensor, which measures $\lambda=AFR/AFR_{stoich}$, the ECM 48 can compute the actual fuel/air equivalence ratio as $\phi=1/\lambda$. The desired fuel/air equivalence ratio at any given point during the transition can be determined by way of interpolation based on the first fuel/air equivalence ratio, the second fuel/air equivalence ratio, and a time since the step of transitioning commenced. The time can be measured in conventional units of time or in relation to combustion events, such as TDCs, and a linear relationship between time and the desired fuel/air equivalence ratio can be assumed for purposes of interpolating the desired value between the first and second fuel/air equivalence ratios.

FIG. 17 also shows that the step of transitioning includes: (a) transitioning from operating the engine 10 according to a current fuel quantity from location 602 determined from a respective initial set of mapped parameter values in map 600 to operating the engine 10 according to a target fuel quantity from location 606 determined from a respective subsequent set of mapped parameter values in map 604, as shown at 1706. As shown at 1708, the step of transitioning also includes: (b) transitioning from operating the engine 10 according to a current air quantity at location 502 determined from a respective initial set of mapped parameter values from map 500 to operating the engine 10 according to a target air quantity from location 506 determined from a respective subsequent set of mapped parameter values from map 504. The transitioning step also includes: (c) transitioning from operating the engine 10 according to a current spark plug activation timing at location 402 determined from a respective initial set of mapped parameter values from map 400 to operating the engine 10 according to a target spark plug activation timing at location 406 determined from a respective subsequent set of mapped parameter values from map 404, as shown at 1710. As shown at 1712, the transitioning step also includes: (d) timing one of commencement and completion of step (b) depending on one of the actual fuel/air equivalence ratio and the desired fuel/air equivalence ratio $\phi$ and timing one of commencement and completion of step (c) depending on one of the actual fuel/air equivalence ratio and the desired fuel/air equivalence ratio $\phi$.

Figure 8:
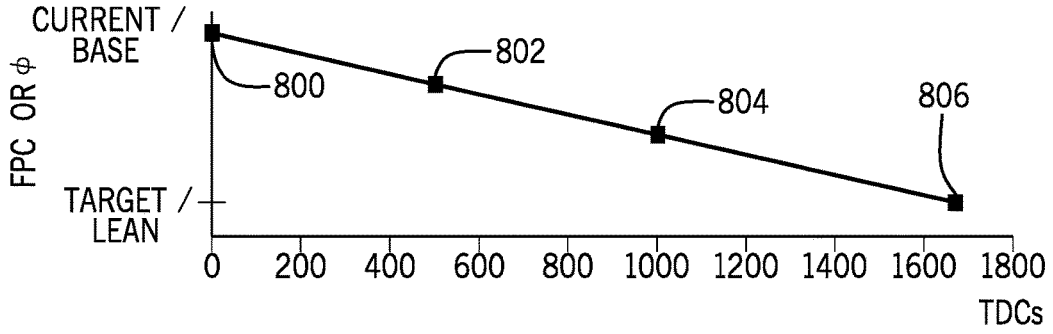
FIG. 8 illustrates a transition from an initial fuel quantity or phi value to a subsequent fuel quantity or phi value when transitioning from operating an engine according to a first, higher fuel/air equivalence ratio to operating the engine according to a second, lower fuel/air equivalence ratio.
Figure 9:
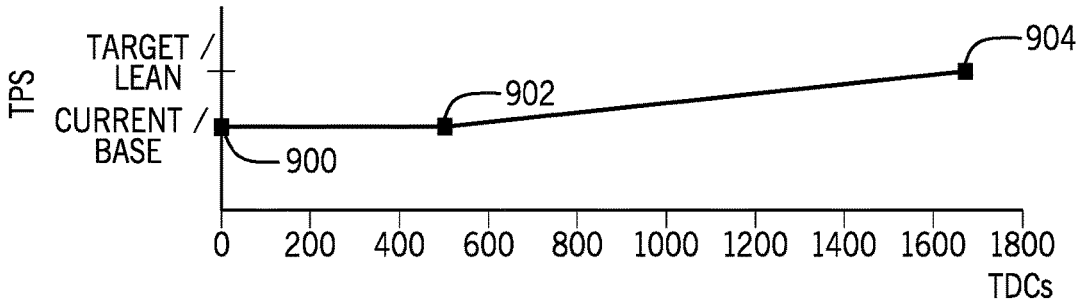
FIG. 9 illustrates a transition from an initial air quantity value to a subsequent air quantity value when transitioning from operating an engine according to the first, higher fuel/air equivalence ratio to operating the engine according to the second, lower fuel/air equivalence ratio.
Figure 10:
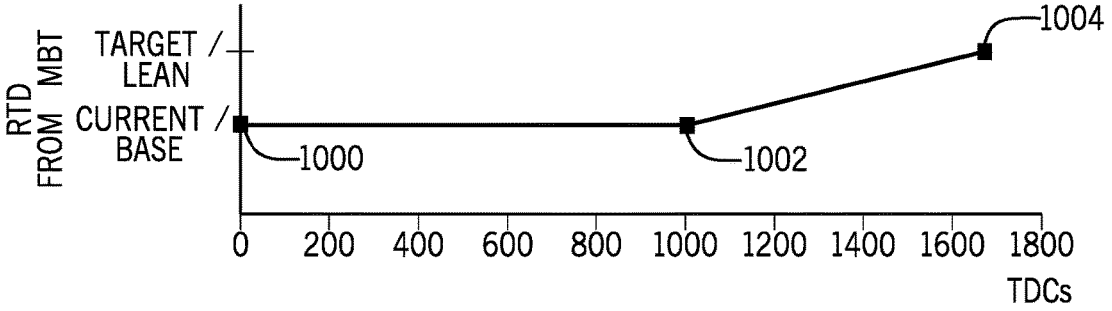
FIG. 10 illustrates a transition from an initial spark plug activation timing value to a subsequent spark plug activation timing value when transitioning from operating an engine according to the first, higher fuel/air equivalence ratio to operating the engine according to the second, lower fuel/air equivalence ratio.

FIGS. 8-10 show graphical depictions of the transition into lean burn, when the first fuel/air equivalence ratio is greater than the second fuel/air equivalence ratio. FIG. 8 shows how upon initiating transition at zero TDCs, the FPC value starts at a current (base) value 800, which would have been previously determined from map 600, and transitions to a target (lean) value 806, determined from map 604. The ECM 48 schedules this transition to occur over about 1650 TDCs, although another time period could be used. FIG. 9 shows how the ECM 48 commences step (b), here related to transitioning the air quantity (see step 1708, FIG. 17), in response to the actual fuel/air equivalence ratio $\phi$ reaching a first predetermined value. In another example, the ECM 48 is programmed to commence step (b) in response to the desired fuel/air equivalence ratio, determined via linear interpolation as noted herein above, reaching the first predetermined value. This first predetermined value is reached at location 802 in FIG. 8, where a particular value of FPC results in an actual $\phi$ value (as determined from the signal from the oxygen sensor 71) or a desired $\phi$ value (as determined via linear interpolation) at which the torque gradient on a phi versus torque plot drastically changes. The beginning of the transitioning of the air quantity value starts at the time the actual or desired phi value reaches the first predetermined value at location 802, which here is at about 500 TDCs, as shown at location 902. The air quantity thereafter transitions from a current (base) value 902 to a target (lean) value at 904. Note that from 900 to 902, the ECM 48 holds the current value of the air quantity (determined from map 500) until the actual or desired fuel/air equivalence ratio $\phi$ reaches the first predetermined value, at location 802.

Similarly, the method includes commencing step (c), here related to transitioning the spark timing (see step 1710, FIG. 17) in response to the actual or desired fuel/air equivalence ratio reaching a second, lesser predetermined value. This occurs at location 804 in FIG. 8, where a particular value of FPC results in an actual phi value as determined by the signal from the oxygen sensor 71 or in a desired phi value as determined via linear interpolation reaching the second predetermined value. As shown in FIG. 10, the beginning of the transitioning of the spark valve timing value (for example, a retarded time from MBT) starts at the time the actual or desired phi value reaches the second predetermined value at location 804, which here is at about 1000 TDCs, as shown at location 1002. The spark plug activation timing thereafter transitions from a current (base) value 1002 to a target (lean) value at 1004. Note that from 1000 to 1002, the ECM 48 holds the current value of the spark plug activation timing (determined from map 400) until the actual or desired fuel/air equivalence ratio $\phi$ reaches the second predetermined value, at location 804.

Figure 11:
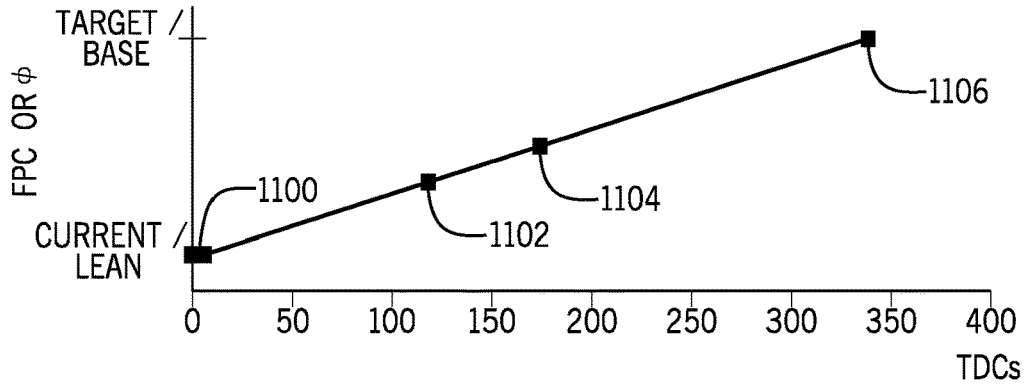
FIG. 11 illustrates a transition from an initial fuel quantity value to a subsequent fuel quantity value when transitioning from operating an engine according to a first, lower fuel/air equivalence ratio to operating the engine according to a second, higher fuel/air equivalence ratio.
Figure 12:
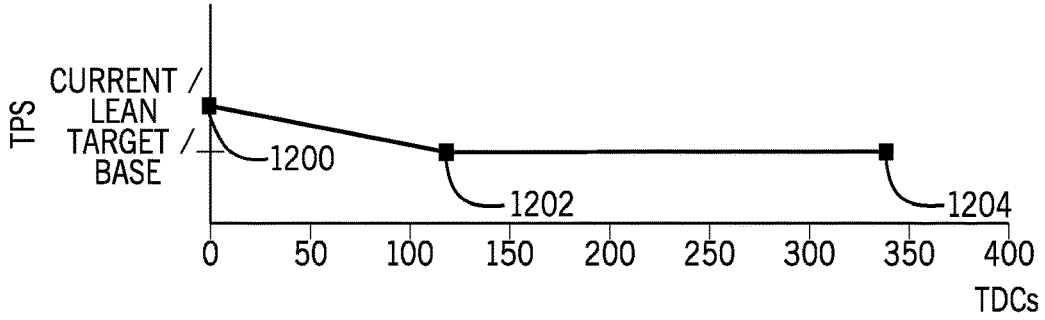
FIG. 12 illustrates a transition from an initial air quantity value to a subsequent air quantity value when transitioning from operating an engine according to the first, lower fuel/air equivalence ratio to operating the engine according to the second, higher fuel/air equivalence ratio.
Figure 13:
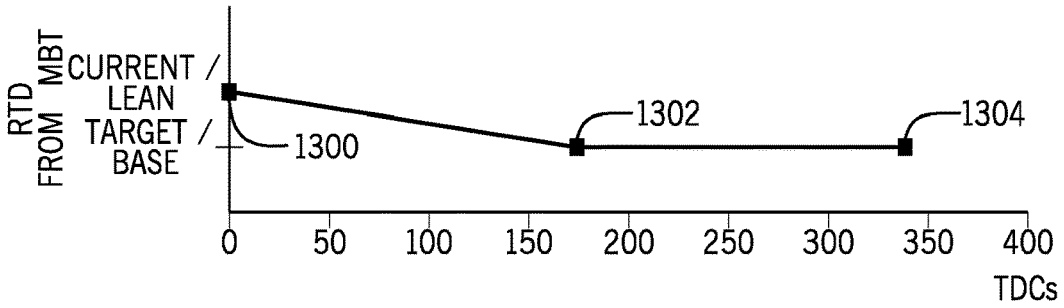
FIG. 13 illustrates a transition from an initial spark plug activation timing value to a subsequent spark plug activation timing value when transitioning from operating an engine according to the first, lower fuel/air equivalence ratio to operating the engine according to the second, higher fuel/air equivalence ratio.

FIGS. 11-13 show graphical depictions of the transition out of lean burn, when the first fuel/air equivalence ratio is less than the second fuel/air equivalence ratio. FIG. 11 shows the FPC value increasing from a current, lean value at 1100 (determined from map 604) to a target, base value at 1106 (determined from map 600). Starting at the same time, air quantity begins to decrease from a current, lean value at 1200 (determined from map 504) to a target, base value at 1202 (determined from map 500). Spark timing also begins to change, from a current, lean value at 1300 (determined from map 404) to a target, base value at 1302 (determined from map 400). At about 120 TDCs, the actual or desired phi value reaches a first predetermined value. This may be the same as the second predetermined phi value corresponding to location 804 in FIG. 8, or slightly different, depending on calibration. At the same time this first predetermined phi value is reached at 1102, the air quantity reaches its target, base value at 1202. Thus, step (b) may be completed in response to the actual or desired fuel/air equivalence ratio $\phi$ reaching a first predetermined value. Thereafter, the target value of the air quantity is held from 1202 to 1204. Similarly, step (d) is completed in response to the actual or desired fuel/air equivalence ratio $\phi$ reaching a second, greater predetermined value. For example, as shown at location 1104 at about 175 TDCs, the actual or desired phi value is equal to the second predetermined value, and the spark timing completes its transition to the target, base value at 1302. Thereafter, the target value of the spark plug activation timing is held from 1302 to 1304. The second predetermined phi value may be the same as at 802 in FIG. 8 and may correspond to where there is a discontinuity in torque gradient while changing fueling amounts. In another example, the second predetermined phi value when transitioning out of lean burn is slightly different than the one used to transition into lean burn, depending on calibration.

Note that the time it takes to transition into lean burn may be different from the time it takes to transition out of lean burn (about 1650 TDCs versus about 340 TDCs) depending on calibration. Note also that when transitioning into lean burn, as shown in FIGS. 8-10, steps (a) transitioning fuel quantity, (b) transitioning air quantity, and (c) transitioning spark activation timing do not all start at the same time. However, the ECM 48 schedules all three of steps (a), (b), and (c) such that they complete simultaneously at 806, 904, and 1004 respectively, at about 1650 TDCs. This represents the end of the transition period, after which the engine 10 is operated according to values determined from the lean burn maps 404, 504, 604 in response to a change in RPM and/or demand. In contrast, FIGS. 11-13 show that the ECM 48 schedules transitions from lean burn to stoichiometric operation such that each of steps (a), (b), and (c) commence simultaneously, here, at zero TDCs. This way, air and spark changes can be ramped out before fuel changes have completed. Such cadencing, both when transitioning into and out of lean burn, virtually eliminates any change in torque that can be felt by the passengers on the vessel.

The above-mentioned unique transition rates bring about gradual transitions from the current value of a given combustion parameter to the target value of a given combustion parameter, and may be accomplished in several ways. For example, the given combustion parameter may transition from a current value to a target value over 10 seconds or over a given number of TDCs. The changes can be smooth, such as at a rate of X units per second, or can be done in a step-wise manner, so long as the steps do not result in noticeable changes in engine performance. In general, the transition is designed to be smooth enough that the operator cannot hear or feel any changes in engine performance.

As noted above with respect to FIG. 16, transitions into and out of lean-burn operation occur at unique rates depending on the combustion parameter in question. Thus, the overall transition into and out of lean-burn operation occurs gradually, i.e., over a non-zero period of time. This allows the ECM 48 to ramp in and ramp out the changes in spark plug activation timing, fuel quantity, and air quantity, such that the operator of the marine vessel does not hear or feel any changes in engine performance. However, if the operator very quickly moves the throttle lever 54 by more than a calibratable limit, instead of using the disable delays and ramps, the ECM 48 will instantaneously return to operating in base maps 400, 500, and 600. When the operator advances the throttle lever 54 very quickly, the transition out of lean-burn-required either because the engine speed dropped below RPM_LOW or rose above RPM_HIGH, or because the throttle position threshold was exceeded (see FIG. 7)—cannot be undertaken gradually because the operator has requested an amount of torque that the lean-burn maps 404, 504, 604 are incapable of providing. Under such conditions, the ECM 48 will ignore any ramp-out scheduling of the combustion parameters and will instead immediately begin operating according to the base maps 400, 500, and 600 for each combustion parameter. Because the operator has already requested a rapid increase or decrease in torque via the throttle lever 54, any torque fluctuations caused by abandoning the ramped, gradual transition are masked.

Figure 18:
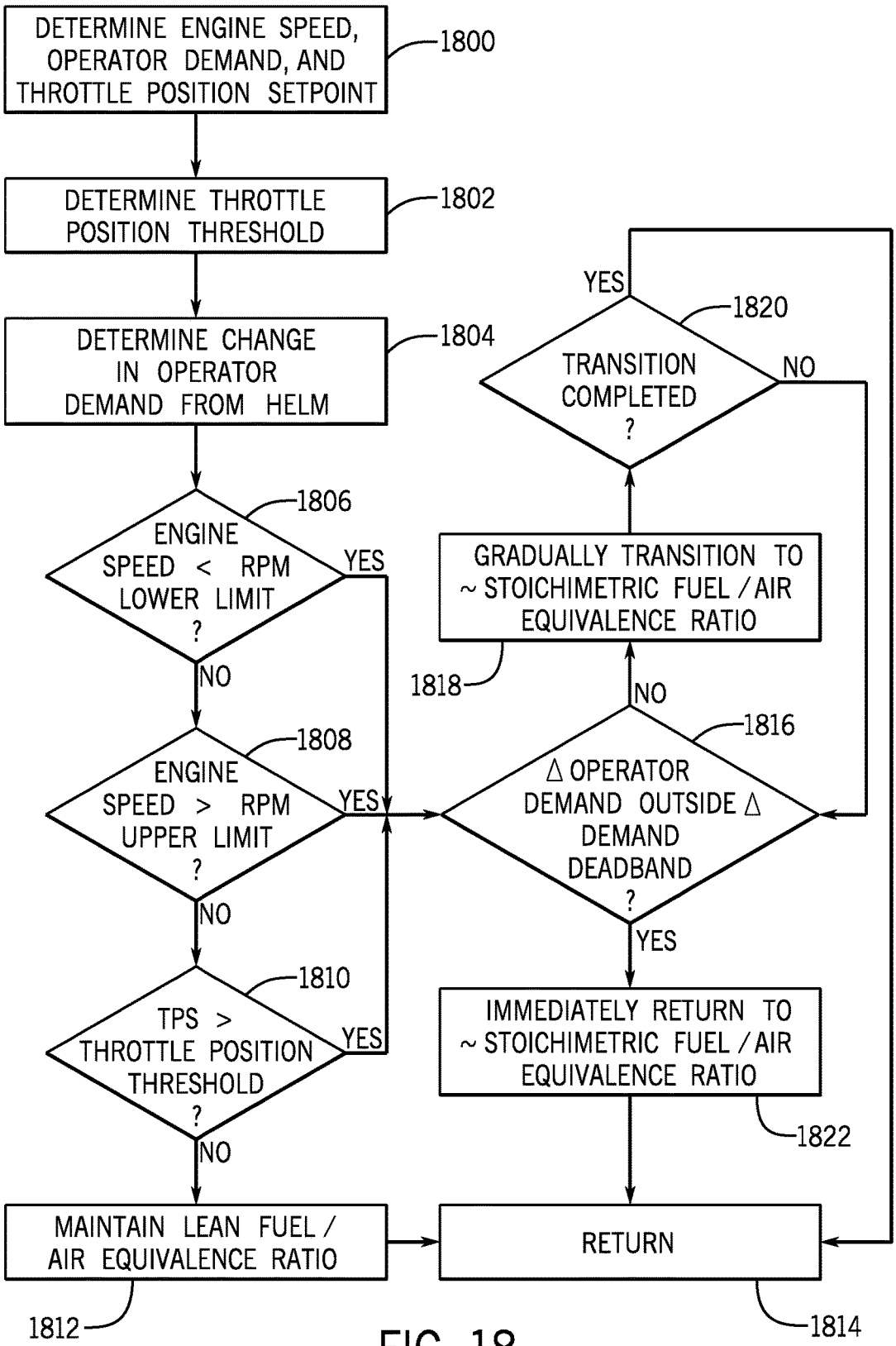
FIG. 18 illustrates a method for determining how to transition between lean burn and stoichiometric operation of the engine.

FIG. 18 illustrates an example of an algorithm that the ECM 48 begins once the system is operating in the lean-burn mode using lean-burn maps 404, 504, and 604 to determine the combustion parameters. As shown at box 1800, the method includes determining the engine speed, the operator demand, and the throttle position setpoint. The engine speed can be measured using the tachometer 46, as noted above. The operator demand is input via the throttle lever 54. The ECM 48 determines the throttle position setpoint based on the operator demand from the throttle lever 54 and other information relating to the operation of the engine 10, as described hereinabove with respect to FIGS. 2, 5A, and 5B. As shown at box 1802, the method also includes determining the throttle position threshold beyond which lean-burn cannot be enabled. The throttle position threshold can be determined based on the current engine speed, such as described with respect to the input-output map 700 shown in FIG. 7.

The method also includes determining a change in operator demand from the helm, as shown at box 1804. Note that this includes an operator demand input via a remote control or a remote helm. The ECM 48 may determine the change in operator demand by comparing a current operator demand from the throttle lever 54 with a filtered operator demand, wherein the change in operator demand is calculated as the difference between the current demand and the filtered demand. Applying a filter to the operator demand filters out noise in the signal from the throttle lever 54 and allows changes in operator demand to be caught as they occur. As shown at decision 1806, the ECM 48 next determines whether the actual engine speed is less than the RPM lower limit. The RPM lower limit is a calibrated value, and an example lower limit RPM_LOW is described hereinabove with respect to FIG. 7. If no, the method continues to decision 1808, where the ECM 48 determines if the engine speed is greater than an RPM upper limit. An example upper limit RPM_HIGH is also shown and described with respect to FIG. 7. If no, the method continues to decision 1810, where the ECM 48 determines if the throttle position setpoint is greater than the throttle position threshold, determined at box 1802. If the answer is no at decision 1810, the method continues to box 1812, and the ECM 48 maintains operation in the lean-burn mode at the lean fuel-air equivalence ratio because the operating conditions are still within the lean-burn mode enablement zone 703 (FIG. 7). The method thereafter continues to box 1814, where it returns to box 1800 for the next iteration.

If any of the decisions at boxes 1806, 1808, or 1810 is yes, then the system can no longer operate in the lean-burn mode because the operating conditions are not within the lean-burn mode enablement zone 703 described hereinabove with respect to FIG. 7. However, disabling the lean-burn mode can be done gradually or abruptly depending on the change in operator demand. Thus, the method next continues to decision 1816, where the ECM 48 determines if the change in operator demand is outside a delta demand deadband. The delta demand deadband is a predetermined deadband having a positive upper limit and a negative lower limit, which indicate the changes in operator demand above and below which the lean-burn combustion parameter maps 404, 504, 604 cannot achieve the torque requested by the operator. The upper and lower limits of the delta demand deadband are calibratable and may depend on the particular vessel application.

If the decision at 1816 is no, the method continues to box 1818, and the ECM 48 gradually transitions from using the lean-burn maps 404, 504, 604 to using the base maps 400, 500, 600, which as noted hereinabove are configured to achieve more or less of a stoichiometric fuel-air equivalence ratio in the engine's combustion chamber(s) 28. The ECM 48 uses the ramps and delays described hereinabove with respect to FIGS. 11-13 and 16 to achieve such a gradual transition. The method thereafter continues to decision 1820, where the ECM 48 determines if the transition to the base maps has completed. If yes, the method continues to box 1814 and thereafter returns to start. If no, the method returns to decision 1816, where it is again determined whether the change in operator demand is outside the delta demand deadband. This recurring determination allows the EMC 48 to catch any changes in operator demand outside the delta demand deadband that occur after a gradual transition back to the base maps has already begun.

If the decision at 1816 is yes, either before or after a transition back to the base maps has begun, the method continues to box 1822, and the ECM 48 immediately returns to operating the engine 10 with a more or less stoichiometric fuel-air equivalence ratio by using the base maps. In such an instance, the ECM 48 has determined that the engine 10 is not capable of providing the torque requested by the operator using the lean-burn maps 404, 504, 604, and must instead abruptly return to using the base maps 400, 500, 600. The method thereafter continues to box 1814 and returns to start.

Thus, if lean-burn operation was already beginning to be ramped out according to box 1818, but then the change in operator demand exceeded the delta demand deadband (decision 1816), the system will immediately be reset to using the base maps. Even if the system had not yet begun to ramp out the lean-burn combustion parameters, if the change in operator demand is outside the delta demand deadband, the system will nonetheless immediately bail directly back to using the base maps so long as the engine speed is outside of an engine speed deadband defined between the lower and upper RPM thresholds (e.g., RPM_LOW and RPM_HIGH), and/or the throttle position setpoint exceeds the throttle position threshold.

During development of the lean-burn algorithm described hereinabove, the present inventors discovered that being able to detect instability of engine operating conditions would be helpful in order to determine whether or not the engine 10 could operate in the lean-burn mode. As described hereinabove with respect to FIG. 15, the ECM 48 monitors critical component faults and can exit lean-burn mode when needed. However, the present inventors recognized that it would also be helpful to determine when operation in the lean-burn mode is unstable (i.e., toggles in and out unintentionally such as during erratic driving), in response to which the lean-burn mode could be temporarily disabled. The algorithms described below thus determine if engine conditions are unstable, after which the lean-burn mode is disabled until a reset condition has been met.

Figure 19:
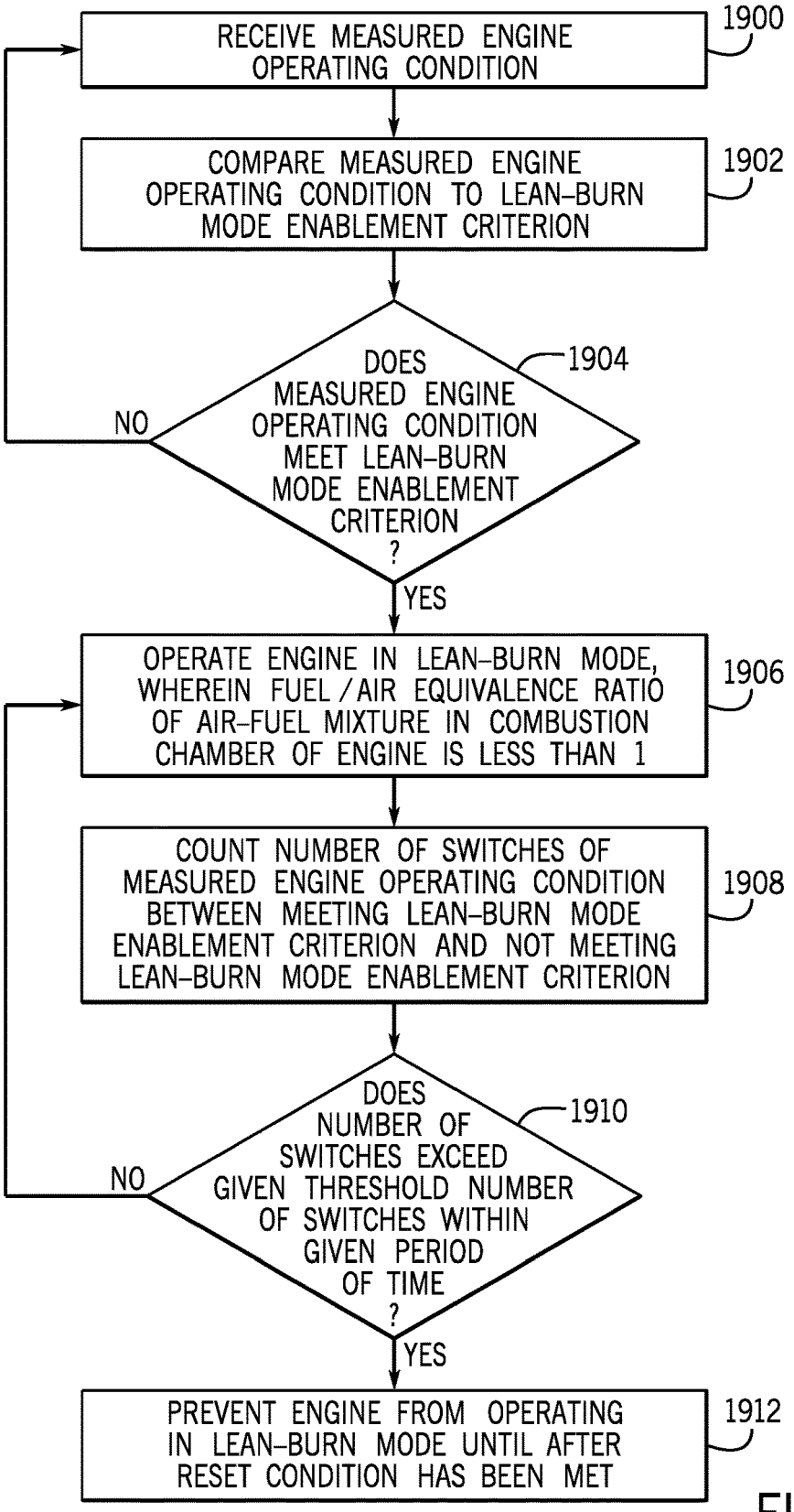
FIG. 19 illustrates a method for preventing the engine from operating in the lean-burn mode when a lean-burn mode enablement criterion is unstable.

Turning to FIG. 19, in one example, a method for controlling a marine internal combustion engine 10 is carried out by a control module (ECM 48) and uses measured engine operating conditions to determine if operation in the lean-burn mode should be temporarily disabled. As shown at box 1900, the method includes receiving a measured operating condition of the engine 10. Next, as shown at box 1902, the method includes comparing the measured engine operating condition to a lean-burn mode enablement criterion. As described hereinabove with respect to FIGS. 7 and 15, the lean-burn mode enablement criterion may include one of the following: the engine 10 is running; a barometric pressure of the atmosphere surrounding the engine 10, as determined by barometric pressure sensor 56, is greater than a predetermined barometric pressure; a predetermined engine fault is not present; a temperature of the engine 10, as determined by temperature sensor 52, is greater than a predetermined temperature; and the engine 10 is operating within a lean-burn mode enablement zone 703 as determined by a combination of the speed of the engine 10 and a load on the engine 10.

Returning to FIG. 19, as shown at box 1904, the method includes determining if the measured engine operating condition meets the lean-burn mode enablement criterion. If the measured engine operating condition does not meet the lean-burn mode enablement criterion (NO at box 1904), the method returns to box 1900 and further includes operating the engine 10 according to the base set of mapped parameter values configured to achieve a fuel/air equivalence ratio of greater than or equal to 1. Alternatively, in response to the measured engine operating condition meeting the lean-burn mode enablement criterion (YES at box 1904), the method includes operating the engine 10 in the lean-burn mode, wherein a fuel/air equivalence ratio of the air-fuel mixture in the combustion chamber 28 of the engine 10 is less than 1, as shown at box 1906. As described hereinabove, operating the engine 10 in the lean-burn mode may include operating the engine 10 according to a lean-burn set of mapped parameter values such as in maps 404, 504, 604 configured to achieve the fuel/air equivalence ratio of less than 1.

Next, as shown at box 1908, the method includes counting a number of switches of the measured engine operating condition between meeting the lean-burn mode enablement criterion and not meeting the lean-burn mode enablement criterion. For example, the ECM 48 may count the number of times the engine speed crosses the RPM_LOW or the RPM_HIGH thresholds described hereinabove as representing the bounds of the lean-burn mode enablement zone 703. This is only one example, and it should be understood that any or all of the lean-burn mode enablement criteria may be monitored. Next, as shown at box 1910, the method includes determining if the number of switches exceeds a given threshold number of switches within a given period of time. For example, the method may include counting a number of switches that occur during a discrete time increment in a series of discrete time increments, each discrete time increment in the series of discrete time increments having a length equal to the period of time. In another example, the method may include counting the number of switches that occur within a moving window, the moving window having a length equal to the period of time. It should be understood that these are only some examples of how the period of time can be defined and are not limiting on the scope of the present disclosure. In one example, the ECM 48 may implement the counting of the number of switches during the given period of time by way of x out of y counter, wherein the number of switches is the x value, and the length of the given period of time is the y value.

The threshold number of switches and the period of time are calibratable. In one example, the threshold number of switches is 12, and the period of time is 60 seconds. In other examples, the threshold number of switches may be 6, and the period of time may be 30 seconds, or the threshold number of switches may be 24 and the period of time may be 120 seconds. It should therefore be understood that the values of x and y in the x out of y counter may vary depending on the desire of the programmer. In one example, the operator of the marine vessel is able to change the x and/or y values via an input device.

If NO at box 1910, the method returns to box 1906, and the engine 10 continues to operate in the lean-burn mode.

However, in response to the number of switches exceeding the given threshold of number of switches within the given period of time (YES at box 1910), the method includes thereafter preventing the engine 10 from operating in the lean-burn mode until after a reset condition has been met, as shown at box 1912. For example, if 14 switches were counted during 60 seconds, and the threshold was 12 switches, operation in the lean-burn mode would be temporarily disabled. If the engine 10 is operating in the lean-burn mode when the number of switches exceeds the given threshold number of switches within the given period of time, the engine 10 must first transition out of operating in the lean-burn mode. In one example, the method includes gradually transitioning to operating the engine 10 according to a different set of mapped parameter values configured to achieve a fuel/air equivalence ratio of greater than or equal to 1 in response to the number of switches exceeding the given threshold number switches within the period of time. For example, a gradual transition can be made back to operating the engine 10 according to the base maps 400, 500, 600, as described hereinabove with respect to FIGS. 11-13. However, in the event that the change in operator demand in response to movement of the throttle lever 54 is outside the delta demand deadband, as described with respect to decision 1816 in FIG. 18, the method may include immediately returning to operating the engine 10 according to the base maps 400, 500, 600.

The reset condition may be met if the engine speed drops below a given lower reset threshold or rises above a given upper reset threshold. In one example, the lower reset threshold is equal to a lower engine speed threshold of the lean-burn mode enablement zone 703 (see, for example, RPM_LOW, FIG. 7), and the upper reset threshold is equal to an upper engine speed threshold of the lean-burn mode enablement zone 703 (see, for example, RPM_HIGH, FIG. 7). In another example, the lower reset threshold is equal to the lower engine speed threshold RPM_LOW of the lean-burn mode enablement zone 703 minus a lower offset, and the upper reset threshold is equal to the upper engine speed threshold RPM_HIGH of the lean-burn mode enablement zone 703 plus an upper offset. The lower offset and the upper offset may be the same value, and may be calibrated. Alternatively, the lower offset and the upper offset may be different from one another. In one example, the lower and upper offsets are both equal to 150 RPM. In still other examples, the reset condition may be that the engine speed has dropped below a predetermined engine idle speed or that the engine speed has been at steady state for a predetermined period of time. Other criteria may be used for the reset condition, such as a stable engine load for a predetermined period of time or an engine load above or below a predetermined value. As another example, the reset condition may be that the operator has pressed a "reset" button at the helm or elsewhere on the vessel, indicating that the operator wishes to be able to operate in the lean-burn mode when the lean-burn mode enablement criteria are next met. In still another example, the engine 10 may be required to go through a key-off, key-on cycle before lean-burn mode can be re-enabled.

In any event, after the reset condition has been met, the system is able to return to operating in the lean-burn mode so long as the lean-burn mode enablement criteria noted hereinabove with respect to box 1502 and decision 1504 of FIG. 15 are met. On the other hand, if the reset condition has not been met, the system cannot return to operation in the lean-burn mode even if the lean-burn mode enablement criteria are met. This prevents repetitive toggling in and out of the lean-burn mode during unstable operating conditions.

Although a single pair of one given measured engine operating condition and one respective lean-burn mode enablement criterion may be used to perform the method of FIG. 19, and only switches between that enablement criterion being met or that enablement criterion not being met could be counted, in another example, the measured engine operating condition is one of multiple measured engine operating conditions, and the lean-burn mode enablement criterion is one of multiple lean-burn mode enablement criteria. In this case, the method includes receiving the measured engine operating conditions and comparing each measured engine operating condition to a respective one of the lean-burn mode enablement criteria. The method may also include operating the engine 10 in the lean-burn mode in response to each measured engine operating condition meeting its respective lean-burn mode enablement criterion. The method may include counting a number of switches of each measured engine operating condition between meeting its respective lean-burn mode enablement criterion and not meeting its respective lean-burn mode enablement criterion. In response to the number of switches associated with any measured engine operating condition exceeding the threshold number of switches within the period of time, the method may include thereafter preventing the engine 10 from operating in the lean-burn mode until after the reset condition has been met. This way, if any condition that is required for operation in lean-burn mode is continually switching from true to false or false to true, the lean-burn mode can be temporarily disabled until after the reset condition is met.

Figure 20:
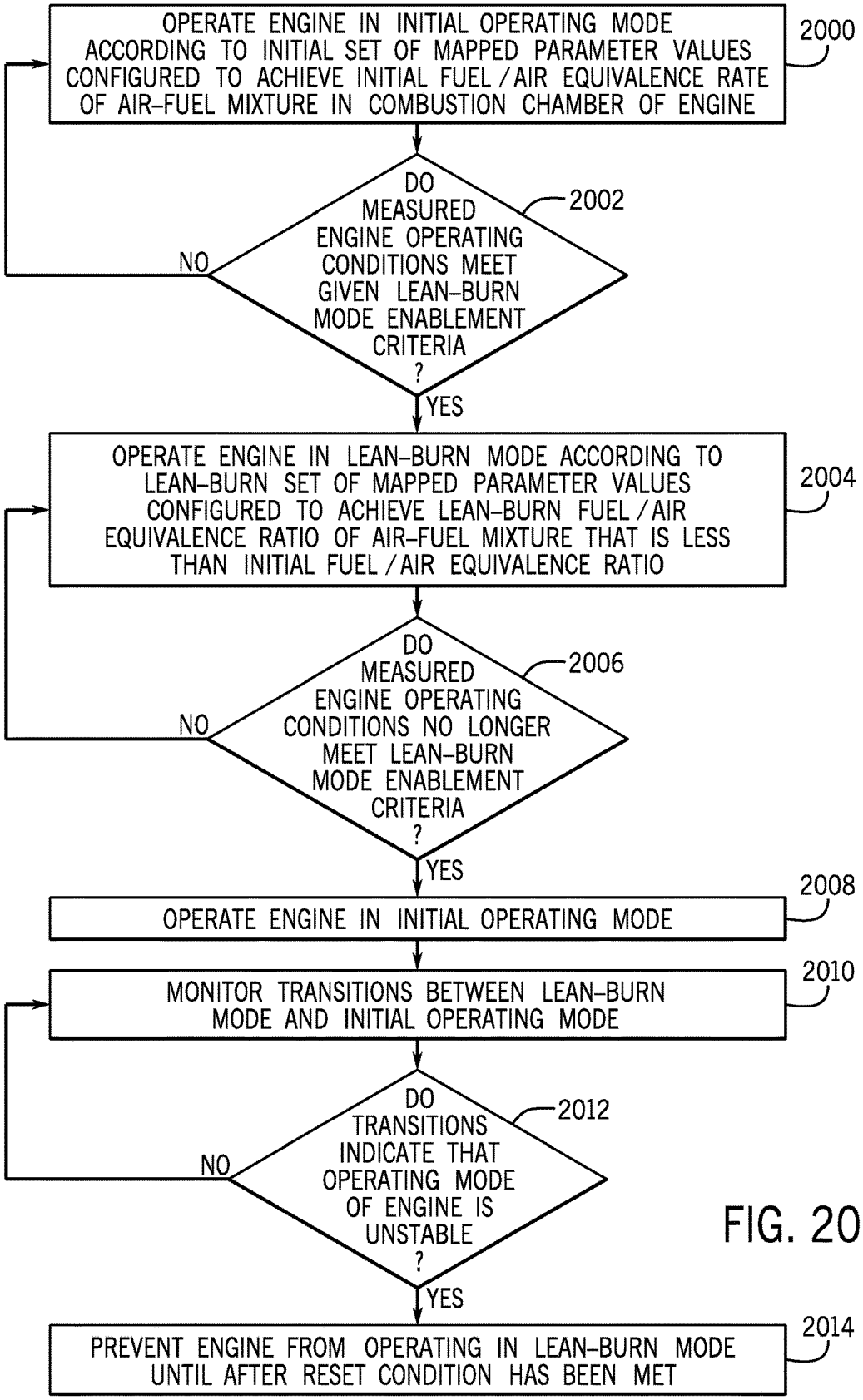
FIG. 20 illustrates a method for preventing the engine from operating in the lean-burn mode when the operating mode of the engine is unstable.

FIG. 20 illustrates a method for controlling an operating mode of a marine internal combustion engine 10, which method includes monitoring state changes within the lean-burn algorithm itself rather than monitoring specific system faults and/or specific engine operating conditions. With respect to box 2000, the method includes operating the engine 10 in an initial operating mode according to an initial set of mapped parameter values (e.g., found in base maps 400, 500, 600) configured to achieve an initial fuel/air equivalence ratio (e.g., a ratio of greater than or equal to 1) of an air-fuel mixture in the combustion chamber 28 of the engine 10. This is the lean-burn disabled state. The method also includes, as shown at 2002, determining if measured engine operating conditions meet given lean-burn mode enablement criteria. If NO, the engine 10 continues to operate in the initial operating mode at box 2000. As shown at box 2004, in response to the measured engine operating conditions meeting the lean-burn mode enablement criteria (YES at box 2002), the method includes operating the engine 10 in the lean-burn mode according to the lean-burn set of mapped parameter values (e.g., found in lean-burn maps 404, 504, 604) configured to achieve a lean-burn fuel/air equivalence ratio (e.g., a ratio of less than 1) of the air-fuel mixture that is less than the initial fuel/air equivalence ratio. This is the lean-burn enabled state. As shown at box 2006, the method also includes determining if the measured engine operating conditions no longer meet the lean-burn mode enablement criteria. If the measured engine operating conditions still meet the lean-burn mode enablement criteria (NO at box 2006), the method returns to box 2004, and the engine 10 continues to operate in the lean-burn mode. However, in response to the measured engine operating conditions no longer meeting the lean-burn mode enablement criteria (YES at box 2006), the method includes operating the engine 10 in the initial operating mode, as shown at box 2008.

The transition from box 2002 to box 2004 and the transition from box 2006 to box 2008 both involve state changes as the system switches from operating in the base/stoichiometric mode (lean-burn disabled state) to operating in the lean-burn mode (lean-burn enabled state) and vice versa. As noted hereinabove with respect to FIGS. 8-13, the method may include gradually transitioning at a non-zero rate from operating the engine 10 according to initial values of given combustion parameters determined from the initial set of mapped parameter values to operating the engine 10 according to respective lean-burn values of the combustion parameters determined from the lean-burn set of mapped parameter values, and vice versa, in response to the measured engine operating conditions meeting or no longer meeting the lean-burn mode enablement criteria, as appropriate. Thus, the transition from box 2002 to box 2004 represents an enable ramp state, and the transition from box 2006 to box 2008 represents a disable ramp state. However, as described hereinabove with respect to FIG. 18, such transitions may instead be instantaneous if the change in operator demand exceeds the delta demand deadband.

As shown at box 2010, the method includes monitoring the above-described transitions between the lean-burn mode and the initial operating mode. As shown at box 2012, the method also includes determining if the transitions indicate that the operating mode of the engine 10 is unstable. Note that the portions of the method in boxes 2010 and 2012 could be carried out throughout the entirety of steps 2000 to 2008 and need not follow box 2008 as shown herein. If NO at box 2012, the method returns to box 2010, and the transitions continue to be monitored. In response to the transitions indicating that the operating mode of the engine 10 is unstable (YES at box 2012), the method includes thereafter preventing the engine 10 from operating in the lean-burn mode until after a reset condition has been met, as shown at box 2014.

Regarding the monitoring of transitions, the method may include counting a number of the transitions that occur and determining that the operating mode of the engine 10 is unstable in response to the number of transitions exceeding a given threshold number of transitions within a given period of time. In one example, the method may include counting the number of transitions that occur during a discrete time increment in a series of discrete time increments, each discrete time increment in the series of discrete time increments having a length equal to the period of time. Alternatively, the method may include counting the number of transitions that occur within a sliding window, which has a length equal to the period of time. The threshold number of transitions and the period of time are calibratable. In one example, the threshold number of transitions is 12, and the period of time is 60 seconds. In other examples, the threshold number of transitions may be 6, and the period of time may be 30 seconds, or the threshold number of transitions may be 24 and the period of time may be 120 seconds. It should be understood that the counting of the transitions could be implemented by way of an x out of y counter, as noted hereinabove, and that the values of x and y are calibratable.

As noted hereinabove, the method of FIG. 20 monitors the state of the lean-burn algorithm rather than specific engine operating conditions in order to determine if the lean-burn mode should be temporarily disabled until the reset condition has been met. Thus, according to the present disclosure, the number of transitions comprises one of the following: (a) a number of times the control module (ECM 48) begins transitioning from operating the engine 10 according to the initial values of the combustion parameters (enable ramp state) and begins transitioning from operating the engine according to the lean-burn values of the combustion parameters (disable ramp state); or (b) a number of times the control module (ECM 48) completes transitioning to operating the engine 10 according to the lean-burn values of the combustion parameters (lean-burn enabled state) and completes transitioning to operating the engine according to the initial values of the combustion parameters (lean-burn disabled state). Thus, the ECM 48 may monitor the number of times transitioning into or out of lean-burn mode begins or the number of times transitioning into or out of lean-burn mode is accomplished. In still other examples, only the number of times that the transition into lean-burn begins or only the number of times that the transition out of lean-burn begins may be monitored, in which case the threshold number of transitions may be lower than when both transitions into lean-burn and transitions out of lean-burn are monitored. It should be understood that any transition into and/or out of an enable ramp state, disable ramp state, lean-burn enabled state, or lean-burn disabled state could be counted for purposes of the present algorithm.

As noted hereinabove, the reset condition may be met if the engine speed drops below a lower reset threshold or rises above a given upper reset threshold. In one example, one of the lean-burn enablement criteria is that the engine 10 is operating within a lean-burn mode enablement zone 703 as determined by a combination of the engine speed and a load on the engine 10 (see FIG. 7), and the lower reset threshold is equal to the lower engine speed threshold RPM_LOW of the lean-burn mode enablement zone 703, while the upper reset threshold is equal to the upper engine speed threshold RPM_HIGH of the lean-burn mode enablement zone 703. In another example, the lower reset threshold is equal to the lower engine speed threshold RPM_LOW of the lean-burn mode enablement zone 703 minus a lower offset, and the upper reset threshold is equal to the upper engine speed threshold RPM_HIGH of the lean-burn mode enablement zone 703 plus an upper offset. The upper and lower offsets are described hereinabove with respect to FIG. 19. The reset condition could alternatively be any of the other conditions described hereinabove with respect to FIG. 19.

The methods of FIGS. 19 and 20 prevent the system from toggling in and out of lean-burn mode due to the engine operating conditions repeatedly meeting and not meeting the lean-burn mode enablement criteria, or due to the enable ramp state, disable ramp state, lean-burn enabled state, or lean-burn disabled state changing repeatedly, both of which cause changes in the engine operating conditions that can be felt and/or heard by the vessel operator. These algorithms help when an engine 10 is having fueling issues, such that the necessary torque is not capable of being provided. In one example, the present method may be helpful for marine vessels used for commercial applications, in which a load on the vessel changes from morning to evening as the vessel is loaded and unloaded throughout the day. By way of another example, if a multiple-engine vessel is being nursed back to port on one engine, but the vessel cannot quite get on plane and the propeller of the working engine is slipping and hooking up repeatedly, the lean-burn mode may be enabled when the propeller slips and the loads lighten, but may be disabled when the propeller hooks up and the load spikes, due to the throttle position setpoint crossing the lean-burn mode enablement thresholds RPM_LOW and RPM_HIGH repeatedly one after the other. As another example, if a vessel is operating in heavy seas, the operator may be constantly working the throttle lever 54 between waves, providing more thrust as the vessel ascends a wave and less thrust as the vessel descends a wave. In such a situation, the operator is not looking for the fuel economy gains provided by operation in the lean-burn mode, and rapid repetitive enablement and disablement of the lean-burn mode only serves to provide unintended noise. The present algorithms allow such repetitive enable/disable of lean-burn mode to be disabled altogether until the reset criteria is met.

In the above description, certain terms have been used for brevity, clarity, and understanding. No unnecessary limitations are to be inferred therefrom beyond the requirement of the prior art because such terms are used for descriptive purposes and are intended to be broadly construed. The order of method steps or decisions shown in the Figures and described herein are not limiting on the appended claims unless logic would dictate otherwise. It should be understood that the decisions and steps can be undertaken in any logical order and/or simultaneously. The different systems and methods described herein may be used alone or in combination with other systems and methods. It is to be expected that various equivalents, alternatives and modifications are possible within the scope of the appended claims. Each limitation in the appended claims is intended to invoke interpretation under 35 U.S.C. § 112(f), only if the terms "means for" or "step for" are explicitly recited in the respective limitation.

What is claimed is:

1. A method for controlling a marine internal combustion engine, the method being carried out by a control module and comprising:

receiving a measured operating condition of the engine;

comparing the measured engine operating condition to a lean-burn mode enablement criterion;

in response to the measured engine operating condition meeting the lean-burn mode enablement criterion, operating the engine in a lean-burn mode, wherein a fuel/air equivalence ratio of an air-fuel mixture in a combustion chamber of the engine is less than 1;

counting a number of switches of the measured engine operating condition between meeting the lean-burn mode enablement criterion and not meeting the lean-burn mode enablement criterion; and in response to the number of switches exceeding a given threshold number of switches within a given period of time, thereafter preventing the engine from operating in the lean-burn mode until after a reset condition has been met.

2. The method of claim 1, wherein the lean-burn mode enablement criterion comprises one of the following:

the engine is running;

a barometric pressure of an atmosphere surrounding the engine is greater than a predetermined barometric pressure;

a predetermined engine fault is not present;

a temperature of the engine is greater than a predetermined temperature; and the engine is operating within a lean-burn mode enablement zone as determined by a combination of a speed of the engine and a load on the engine.

3. The method of claim 2, wherein the reset condition is met if the engine speed drops below a given lower reset threshold or rises above a given upper reset threshold.

4. The method of claim 3, wherein the lower reset threshold is equal to a lower engine speed threshold of the lean-burn mode enablement zone, and the upper reset threshold is equal to an upper engine speed threshold of the lean-burn mode enablement zone.

5. The method of claim 3, wherein the lower reset threshold is equal to a lower engine speed threshold of the lean-burn mode enablement zone minus a lower offset, and the upper reset threshold is equal to an upper engine speed threshold of the lean-burn mode enablement zone plus an upper offset.

6. The method of claim 1, wherein operating the engine in the lean-burn mode comprises operating the engine according to a lean-burn set of mapped parameter values configured to achieve the fuel/air equivalence ratio of less than 1.

7. The method of claim 6, further comprising operating the engine according to a different set of mapped parameter values configured to achieve a fuel/air equivalence ratio of greater than or equal to 1 if the measured engine operating condition does not meet the lean-burn mode enablement criterion.

8. The method of claim 6, further comprising gradually transitioning to operating the engine according to a different set of mapped parameter values configured to achieve a fuel/air equivalence ratio of greater than or equal to 1 in response to the number of switches exceeding the threshold number of switches within the period of time.

9. The method of claim 1, further comprising counting the number of switches that occur during a discrete time increment in a series of discrete time increments, each discrete time increment in the series of discrete time increments having a length equal to the period of time.

10. The method of claim 1, wherein the measured engine operating condition is one of multiple measured engine operating conditions, and the lean-burn mode enablement criterion is one of multiple lean-burn mode enablement criteria; and wherein the method further comprises:

receiving the measured engine operating conditions and comparing each measured engine operating condition to a respective one of the lean-burn mode enablement criteria;

operating the engine in the lean-burn mode in response to each measured engine operating condition meeting its respective lean-burn mode enablement criterion;

counting a number of switches of each measured engine operating condition between meeting its respective lean-burn mode enablement criterion and not meeting its respective lean-burn mode enablement criterion; and in response to the number of switches associated with any measured engine operating condition exceeding the threshold number of switches within the period of time, thereafter preventing the engine from operating in the lean-burn mode until after the reset condition has been met.

11. A method for controlling an operating mode of a marine internal combustion engine, the method being carried out by a control module and comprising:

operating the engine in an initial operating mode according to an initial set of mapped parameter values configured to achieve an initial fuel/air equivalence ratio of an air-fuel mixture in a combustion chamber of the engine;

in response to measured operating conditions of the engine meeting given lean-burn mode enablement criteria, operating the engine in a lean-burn mode according to a lean-burn set of mapped parameter values configured to achieve a lean-burn fuel/air equivalence ratio of the air-fuel mixture that is less than the initial fuel/air equivalence ratio;

in response to the measured engine operating conditions no longer meeting the lean-burn mode enablement criteria, operating the engine in the initial operating mode;

monitoring transitions between the lean-burn mode and the initial operating mode; and in response to the transitions indicating that the operating mode of the engine is unstable, thereafter preventing the engine from operating in the lean-burn mode until after a reset condition has been met.

12. The method of claim 11, further comprising counting a number of the transitions that occur, and determining that the operating mode of the engine is unstable in response to the number of transitions exceeding a given threshold number of transitions within a given period of time.

13. The method of claim 12, further comprising counting the number of transitions that occur during a discrete time increment in a series of discrete time increments, each discrete time increment in the series of discrete time increments having a length equal to the period of time.

14. The method of claim 13, wherein the threshold number of transitions is 12, and the period of time is 60 seconds.

15. The method of claim 12, further comprising gradually transitioning at a non-zero rate from operating the engine according to initial values of given combustion parameters determined from the initial set of mapped parameter values to operating the engine according to respective lean-burn values of the combustion parameters determined from the lean-burn set of mapped parameter values, and vice-versa, in response to the measured engine operating conditions meeting or no longer meeting the lean-burn mode enablement criteria, as appropriate.

16. The method of claim 15, wherein the number of transitions comprises one of the following:

a number of times the control module begins transitioning from operating the engine according to the initial values of the combustion parameters and begins transitioning from operating the engine according to the lean-burn values of the combustion parameters; or a number of times the control module completes transitioning to operating the engine according to the lean-burn values of the combustion parameters and completes transitioning to operating the engine according to the initial values of the combustion parameters.

17. The method of claim 11, wherein the reset condition is met if a speed of the engine drops below a given lower reset threshold or rises above a given upper reset threshold.

18. The method of claim 17, wherein one of the lean-burn mode enablement criteria is that the engine is operating within a lean-burn mode enablement zone as determined by a combination of the engine speed and a load on the engine; and wherein the lower reset threshold is equal to a lower engine speed threshold of the lean-burn mode enablement zone, and the upper reset threshold is equal to an upper engine speed threshold of the lean-burn mode enablement zone.

19. The method of claim 17, wherein one of the lean-burn mode enablement criteria is that the engine is operating within a lean-burn mode enablement zone as determined by a combination of the engine speed and a load on the engine; and wherein the lower reset threshold is equal to a lower engine speed threshold of the lean-burn mode enablement zone minus a lower offset, and the upper reset threshold is equal to an upper engine speed threshold of the lean-burn mode enablement zone plus an upper offset.

20. The method of claim 11, wherein the lean-burn mode enablement criteria comprise one or more of the following:

the engine is running;

a barometric pressure of an atmosphere surrounding the engine is greater than a predetermined barometric pressure;

a predetermined engine fault is not present;

a temperature of the engine is greater than a predetermined temperature; and the engine is operating within a lean-burn mode enablement zone as determined by a combination of a speed of the engine and a load on the engine.

* * * * *